US009583325B2

(12) United States Patent
Krogh et al.

(10) Patent No.: US 9,583,325 B2
(45) Date of Patent: Feb. 28, 2017

(54) SYSTEM AND METHOD OF DELICATE MEMBRANE CONDENSED PHASE MEMBRANE INTRODUCTION MASS SPECTROMETRY (CP-MIMS)

(71) Applicants: Erik Krogh, Nanaimo (CA); Christopher Gill, Lantzville (CA)

(72) Inventors: Erik Krogh, Nanaimo (CA); Christopher Gill, Lantzville (CA)

( * ) Notice: Subject to any disclaimer, the term of this patent is extended or adjusted under 35 U.S.C. 154(b) by 0 days.

(21) Appl. No.: 14/924,660

(22) Filed: Oct. 27, 2015

(65) Prior Publication Data

US 2016/0056030 A1 Feb. 25, 2016

Related U.S. Application Data

(63) Continuation-in-part of application No. PCT/IB2014/061064, filed on Apr. 28, 2014.

(60) Provisional application No. 61/827,936, filed on May 28, 2013.

(51) Int. Cl.

| | |
|---|---|
| ***H01J 49/10*** | (2006.01) |
| ***H01J 49/04*** | (2006.01) |
| ***H01J 49/00*** | (2006.01) |

(52) U.S. Cl.

CPC ..... *H01J 49/0436* (2013.01); *H01J 49/0031* (2013.01)

(58) Field of Classification Search

USPC ..... 250/281, 282, 288

See application file for complete search history.

(56) References Cited

U.S. PATENT DOCUMENTS

| | | | | |
|---|---|---|---|---|
| 4,791,292 | A | 12/1988 | Cooks et al. | |
| 5,703,359 | A | 12/1997 | Wampler | |
| 6,485,689 | B1 | 11/2002 | Huang et al. | |
| 2004/0180147 | A1* | 9/2004 | Parikh | B82Y 30/00 427/558 |
| 2005/0191759 | A1* | 9/2005 | Pedersen-Bjergaard | B01L 3/50853 436/177 |

(Continued)

OTHER PUBLICATIONS

WIPO, Canadian International Searching Authority, International Search Report mailed Aug. 18, 2014, International Patent Application No. PCT/IB2014/061064, 4 Pages.

(Continued)

*Primary Examiner* — Nicole Ippolito

(74) *Attorney, Agent, or Firm* — Baumgartner Patent Law; Marc Baumgartner

(57) ABSTRACT

Systems and methods for analyzing a sample comprising an analyte selected from a volatile organic compound, a semi-volatile organic compound, a non-volatile organic compound, a polar organic compound and a halogenated non-volatile organic compound are provided. The systems comprises an ionization source, a flow cell or an immersion probe with a delicate membrane, the flow cell or immersion probe for accepting the sample, and the delicate membrane interface in fluid communication with the ionization source and a mass spectrometer. The flow cell system further comprises a simultaneously matched pumping in and out delivery (SMPIOD) system for delivering an acceptor phase comprising the analyte from the delicate membrane interface to the mass spectrometer at a constant acceptor flow pressure and a constant acceptor flow rate.

21 Claims, 23 Drawing Sheets

(56) References Cited

U.S. PATENT DOCUMENTS

| | | | | |
|---|---|---|---|---|
| 2005/0236565 | A1 | 10/2005 | Oser et al. | |
| 2009/0020696 | A1 | 1/2009 | Bier | |
| 2010/0072066 | A1* | 3/2010 | Pedersen-Bjergaard | B01D 61/38 204/540 |
| 2010/0312483 | A1* | 12/2010 | Peyser | G01N 33/52 702/19 |
| 2015/0132746 | A1* | 5/2015 | Gjelstad | A61B 5/1405 435/6.1 |

OTHER PUBLICATIONS

Cisper et. al., "The Direct Analysis of Semi-volatile Organic Compounds by Membrane Introduction Mass Spectrometry", Rapid Communications in Mass Spectrometry, 1997, 11, pp. 1449-1453.
Alberici et al., "Polyetherimide-silicone: a 10 mm ultrathin composite membrane for faster and more sensitive membrane introduction mass spectrometry analysis", Analytical Communications, 1999, 36, pp. 221-223.
Ketola et al., "Environmental applications of membrane introduction mass spectrometry", J Mass Spectrom. May 2002;37(5):457-76. Abstract Only.
Kana et al., "Membrane Inlet Mass Spectrometer for Rapid High-Precision Determination of N2, O2, and Ar in Environmental Water Samples", Anal. Chem., 1994, 66 (23), pp. 4166-4170.

* cited by examiner

SYSTEM AND METHOD OF DELICATE MEMBRANE CONDENSED PHASE MEMBRANE INTRODUCTION MASS SPECTROMETRY (CP-MIMS)

RELATED APPLICATIONS

This application is a continuation-in-part of International Application No. PCT/IB2014/061064, filed 28 Apr. 2014 which claims the benefit of Provisional Application No. 61/827,936, filed 28 May, 2013, both entitled SYSTEM AND METHOD OF DELICATE MEMBRANE CONDENSED PHASE MEMBRANE INTRODUCTION MASS SPECTROMETRY (CP-MIMS). The entire contents of each of the above-identified prior applications are hereby incorporated by reference.

FIELD OF THE INVENTION

The present technology relates to an apparatus and method to rapidly quantify non-volatile, polar compounds directly in complex samples and continuously monitor in an online real-time manner, in which delicate membranes are used. More specifically, the technology relates to delicate membrane Condensed Phase Membrane Introduction Mass Spectrometry (CP-MIMS) and use thereof.

DESCRIPTION OF THE RELATED ART

Membrane introduction mass spectrometry (MIMS) has been extensively used over the past four decades as a direct, real-time sampling interface for mass spectrometry. Small, hydrophobic, and volatile compounds (SHV analytes), permeate through a semi-permeable membrane, as a mixture, while the majority of the sample matrix is rejected. These can then be characterized based on differences in permselectivity, unique mass-to-charge ratios, and by tandem mass spectrometry (MS/MS). By design, MIMS eliminates the need for sample cleanup and chromatographic separation from complex matrices prior to analysis by mass spectrometry. For these reasons, in conjunction with its ability to provide temporally and spatially resolved information in a real-time manner (when mounted on a mobile platform), MIMS has demonstrated potential for environmental monitoring and rapid screening of SHV analytes.

Membrane transport across the MIMS membrane involves SHV analyte partitioning into the semi-permeable membrane, diffusion through the membrane material/s and partitioning out of the membrane at the opposite surface. When the analytes desorb in the gas phase, the entire process is termed pervaporation. Membrane transport occurs under a concentration gradient and is governed by Fick's Laws of diffusion. There is an inherent enrichment of SHV analytes in the membrane, owing to their relative solubility in the membrane versus the matrix.

To date, mainly polymer membranes have been used for most MIMS applications to separate the sample (typically gaseous or aqueous) from a gaseous acceptor phase (or vacuum) leading to the ionization source of the mass spectrometer. This 'conventional' approach to MIMS is ideal for small, hydrophobic, and volatile compounds, yielding signal response times on the order of seconds to minutes and parts-per billion (ppb) to parts-per-trillion (pptr) level detection limits. For example, U.S. Pat. No. 5,703,359 to Wampler, discloses a composite membrane and support assembly for treating a fluid sample for introduction to a mass spectrometer. The composite membrane and support assembly allows analyses of volatile compounds in field situations. The membrane is made of polycarbonate and dimethylsilicone with a non-woven polyester support, in addition to a rigid perforated member for supporting the membrane and the fiber support. Volatile analytes from a sample flow permeate through a membrane free from the undesired background matrix. Typically, the membranes are made from polydimethylsiloxane (PDMS).

Conventional 'Gaseous' acceptor phase MIMS (GP-MIMS), can suffer from longer response times and lower sensitivity for larger, and less volatile molecules that are slower to permeate through (hydrophobic) PDMS membranes. For this reason, there have been many efforts to extend the utility of the technique to larger and less volatile compounds through heating of the membrane surface for improved pervaporation, alternative desorption techniques, alternative membrane materials, such as Nafion® (sulfonated tetrafluoroethylene based fluoropolymer-copolymer) and alternative systems and methods. The transport of analytes across a membrane interface in GP-MIMS is inherently passive (dissipative), driven by a concentration gradient.

One alternative system and method for identifying nitro compounds, organic molecules containing halogens, volatile organic compounds (VOCs), such as benzene, toluene, and xylene, inorganic compounds such as metal and heavy atoms, aromatic ketones and large biomolecules is disclosed in United States Patent Application 20050236565 to Oser, et al. The liquid sample is introduced through a continuous flow membrane inlet system. The analytes that permeate the membrane are analyzed by photoionization-time-of-flight mass spectrometry. The analytes remaining in the liquid sample that do not permeate the membrane are conducted to a capillary tube inlet that introduces the liquid sample and other analytes as droplets into the photoionization zone. Any analytes remaining absorbed or adsorbed on the membrane are driven through the membrane by application of heat. Analytes may be analyzed by either resonance enhanced multiphoton ionization (REMPI) or single photon ionization (SPI), both of which are provided in the apparatus and can be selected as alternative sources.

Yet another approach is to use fragile membrane substrates including very thin and composite hollow fiber membrane (HFM) and supported liquid membranes (SLM) with GP-MIMS for analyzing semi-volatile organic compounds (SVOCs). For example, Cisper et. al. (Rapid Communications in Mass Spectrometry, 1997, 11, pp 1449) used a composite PDMS/micro-porous polypropylene interface to directly monitor SVOCs in air and water at ppb-pptr levels by GP-MIMS. The authors found a number of advantages in the thinness of the composite membrane, including less sampling time for trace (ppb-pptr) SVOC analysis, and little to no sample carry over between measurements. Alberici et. al. (Analytical Communications, 1999, 36, pp 221) used a PDMS/polyetherimide composite sheet membrane interface for the analysis of VOCs in water. They found that the 10 μm thick PDMS layer gave substantially shortened response and recovery times for VOCs, but the observed sensitivity suffered at times due to a large amount of water permeation.

Recently, researchers have begun using a membrane introduction sampling interface to a mass spectrometer with a condensed (liquid) acceptor phase in place of a gaseous acceptor phase, in conjunction with a direct liquid ionization technique. This approach, termed Condensed Phase Membrane Introduction Mass Spectrometry (CP-MIMS) demonstrates low pptr-ppb detection limits for non-volatile polar analytes that are not amenable to conventional GP-MIMS.

One example of CP-MIMS, referred to as electrospray (ESI) ionization MIMS, is disclosed in United States Patent Application 20090020696 to Bier. The apparatus used for the method couples a membrane interface directly to a mass spectrometer at atmospheric pressure. The membrane may be in capillary or sheet form and allows the introduction of a liquid or gaseous sample to one side of the membrane while the other side of the membrane is bathed with an appropriate solution that can easily be used in an atmospheric pressure ionization source. The method is preferably done under heat. Volatile molecules permeate through a suitable membrane such as poly-dimethyl silicone (PDMS), mix into the appropriate solvent, and are ionized. The detection limits were in the low ppb to high pptr range, with the exception of acetic acid, trifluoroacetic acid, and 2,4-dinitrophenol, all of which had detection limits in the ppm range. The analysis is destructive as the samples are introduced as discrete volumes using a sampling loop and valve that transfers them as segments of liquid in a sample carrier solvent, meaning that the original sample cannot be recovered.

The CP-MIMS technique allows for direct analysis of complex mixtures of chemical compounds in complex sample matrices yielding superior sensitivity and improved response times over GP-MIMS for many molecules that are environmentally, and bio-analytically significant. This includes molecules with very low volatility, as well as polar, hydrophilic analytes, whose transport in a gaseous membrane acceptor phase is impractical or impossible. Furthermore, the transport of analytes across a membrane into a condensed acceptor phase can be driven by various active transport mechanisms. Coupling the analyte concentration gradient with that of other chemical species (e.g., acids/bases, complexating agents, carriers, enzymes etc) can improve both sensitivity and selectivity in CP-MIMS applications. The technology allows for screening of complex environmental or biological samples for low concentrations of certain classes of semi- and non-volatile analytes with little or no sample handling, clean up and/or chromatography, thereby reducing time, expense and labour.

At present, it remains difficult to analyze low volatility, polar analytes by GP-MIMS. They suffer from poor sensitivity and long response times. Consequently, this technique cannot be practically used to continuously monitor these analytes in an on-line fashion and/or follow dynamic changes in their concentration profile (i.e., chemical kinetics). CP-MIMS with thick polymer membranes (>250 μm) have been employed to overcome some of these deficiencies and can be extended to a wider range of low volatility, polar analytes but their application is limited to fairly small molecules (typically less than 250 amu). Larger molecules are slow to transit the membrane and suffer from long response times which make them impractically slow for rapid screening, continuous monitoring and/or following chemical kinetics.

A significant number of environmental and biologically relevant molecules (e.g., naphthenic acids, drug metabolites, micropollutants, perfluorinated octanoic acids and natural organic matter) are considerably larger than 250 amu and cannot be practically measured with current CP-MIMS techniques. These compound classes are often present as complex assemblies of structurally related molecules in which the distribution of individual molecules provides relevant environmental forensics. The timeframe to analyze non-volatile and/or non-volatile polar species, and/or non-volatile charged species using CP-MIMS can be long, and is therefore not always practical. Furthermore, when a non-destructive analysis technique is sought, such that the same sample can be subsequently measured by another technique, sensitive analytical techniques that do not consume large quantities of analyte are desirable. Current CP-MIMS techniques consume significant quantities of analyte thereby depleting the sample.

Although PDMS membranes act to preclude many problematic matrix species (such as salts and ionized molecules), it is apparent that co-permeating neutral matrix molecules can result in suppressed analyte signals. As a result, quantitation of analytes directly from complex samples by CP-MIMS coupled to an ESI source using direct calibration, or even with standard additions, presents a challenge.

To address the above and other shortcomings, below are provided a system and methods for delicate membrane CP-MIMS, which are able to provide rapid screening capabilities, continuous on line screening in real time, analysis of analytes in complex mixtures, analysis of analytes present in small quantities in the mixtures, compositional analysis of complex compound classes, non-destructive analysis and the ability to follow changes in chemical concentration over time.

SUMMARY OF THE INVENTION

The present technology provides delicate membrane CP-MIMS systems. The systems allow for the use of delicate membrane interfaces, including thin PDMS, composite PDMS/micro-porous polypropylene hollow fiber membrane (HFM) and supported liquid membrane (SFM) interfaces. The described CP-MIMS systems using these delicate HFM exhibits improved performance characteristics. The delicate membrane systems can function in continuous monitoring mode and also 'trap-and-release' mode for enhanced analytical sensitivity. Using ESI, Atmospheric-pressure chemical ionization (ACPI), Atmospheric pressure photo ionization (APPI), Corona discharge and other ionization methods and sources, in both selected ion monitoring (SIM) and MS/MS modes for analyte detection, fluid handling has been optimized as has response times and detection limits for a variety of analytes in aqueous samples.

The use of delicate membrane CP-MIMS allows one to make accurate measurements of molecules present in very low concentrations in complex mixtures in a practical timeframe without sample preparation, clean-up or chromatography. The duty cycle of delicate membrane CP-MIMS is fast enough (seconds to minutes) that it allows rapid screening at high sensitivity (ppb or lower) for polar/low volatility species. Further, the analysis is non-destructive and allows for resampling by recirculating or re-measuring the sample or for re-analysis by other techniques after making the CP-MIMS measurement.

In a first embodiment, a system is provided for analyzing a sample comprising an analyte selected from a volatile organic compound, a semi-volatile organic compound, a non-volatile organic compound, a polar organic compound and a halogenated non-volatile organic compound. The system comprises:

- an ionization source;
- a mass spectrometer
- a flow cell with a delicate membrane interface mounted therein, the flow cell for accepting the sample;
- the delicate membrane interface in fluid communication with the ionization source and the mass spectrometer; and
- a simultaneously matched pumping in and out delivery (SMPIOD) system for delivering an acceptor phase comprising the analyte from the delicate membrane interface to the mass spectrometer at a constant acceptor flow pressure and a constant acceptor flow rate.

The delicate membrane interface is a hollow fibre membrane (HFM) comprising polydimethylsiloxane, of about 0.5 microns to about 250 microns in thickness. The HFM is a composite PDMS/micro-porous polypropylene HFM, a thin PDMS HFM or a supported liquid membrane HFM. The membrane could also be a sheet membrane of the same thickness employed in a suitable mounting cell.

The flow cell can be coupled to a recirculation system that allows for recirculation of the sample.

The system can be configured for continuous flow such that both the sample and the acceptor phases are continuously flowing.

The SMPIOD is preferably configured to maintain the acceptor flow rate at a consistent rate between about 100 nL to about 1000 μL/minute and the acceptor flow pressure at a consistent pressure.

A method of analyzing a sample comprising an analyte selected from a volatile organic compound, a semi-volatile organic compound, a non-volatile organic compound, a polar organic compound and a halogenated non-volatile organic compound is also provided, the method comprising introducing the sample into the first embodiment and receiving an output The acceptor flow rate is maintained at a consistent flow rate between about 100 nL to about 1000 μL/minute and the acceptor flow pressure is maintained at a consistent flow pressure between about 90 to about 110 kPa.

The sample may be continuously flowed in a single pass through the interface.

The method may further comprise recirculating the sample.

The method may further comprise measuring change in the analyte concentration over time, on line in real time.

The sample may comprise naphthenic acids.

The sample may comprise complex mixtures.

A delicate membrane system for use with an ionization source and a Mass Spectrometer is also provided. The system comprises:

a flow cell with a delicate membrane interface mounted therein, the flow cell for accepting a sample;

the delicate membrane interface for fluid communication with the ionization source and the Mass Spectrometer; and a simultaneously matched pumping in and out delivery (SMPIOD) system for delivering an acceptor phase comprising the analyte from the delicate membrane interface to the Mass Spectrometer at a constant acceptor flow pressure and a constant acceptor flow rate.

The delicate membrane interface is a hollow fibre membrane (HFM) comprising polydimethylsiloxane (PDMS), of about 0.5 microns to about 250 microns in thickness. The HFM is a composite PDMS/micro-porous polypropylene HMF, a thin PDMS HMF or a supported liquid membrane HMF. The membrane could also be a sheet membrane of the same thickness employed in a suitable mounting cell.

The flow cell may be coupled to a recirculation system that allows for recirculation of the sample.

A method of analyzing a sample comprising analytes selected from volatile organic compounds, semi-volatile organic compounds, non-volatile organic compounds, polar organic compounds and halogenated non-volatile organic compounds is also provided. The method comprises:

introducing the sample into a flow cell with a delicate membrane interface mounted therein;

separating the analytes with the delicate membrane interface; and delivering an acceptor phase at a constant acceptor flow pressure and a constant acceptor flow rate, to an ionization source and a Mass Spectrometer, the acceptor phase comprising the analyte; and receiving an output, thereby of analyzing the sample comprising the analyte.

The acceptor flow rate is maintained at a consistent flow rate between about 100 nL to about 1000 μL/minute and the acceptor flow pressure is maintained at a consistent pressure.

The analysis is conducted under ambient temperature conditions.

The method may further comprise continuously flowing the sample.

The method may further comprise recirculating the sample.

The analysis may be rapid.

The sample may comprise naphthenic acids.

The sample may comprise complex mixtures.

In a second embodiment, a system for analyzing a sample comprising an analyte is provided. The system comprises:

an acceptor phase supply comprising an acceptor phase;

an ionization source;

a mass spectrometer; and a membrane interface device, the device comprising a membrane interface in fluid communication with an acceptor phase carrier, the membrane interface configured for bathing in the sample, under ambient pressure, the acceptor phase carrier in fluid communication with the acceptor phase supply, the ionization source and the mass spectrometer.

The membrane interface is a hollow fibre membrane (HFM) comprising polydimethylsiloxane, of no more than about 225 microns in thickness. The membrane may be a thin membrane or it may be a supported liquid membrane.

The system may further comprise a mixer for mixing the sample.

The immersion probe may be a J probe or it may be a miniature coaxial probe.

The system may further comprise an autosampler.

A method is also provided for continuous on-line measurements for a trace level analyte in a sample, the sample being at least about 1.0 μL. The method comprises utilizing the system described as the second embodiment and obtaining an output.

The sample may be a biological sample.

The sample may be an environmental sample.

The method may further comprise rapid pre-screening the sample and providing the sample for further analyzing.

The method may be for direct, in vivo or in situ monitoring of the biological or environmental samples.

An immersion probe for use with an ionization source and a mass spectrometer is also provided. The immersion probe comprises a membrane interface coaxial with an acceptor phase delivery capillary and for fluid communication with an acceptor phase, the membrane interface configured for bathing in the sample, under ambient pressure, the acceptor phase delivery capillary for fluid communication with acceptor phase supply, the ionization source and the mass spectrometer.

The membrane interface is a hollow fibre membrane (HFM) comprising polydimethylsiloxane, of about 0.5 microns to about 225 microns in thickness.

The HFM is a composite PDMS/micro-porous polypropylene HMF, a thin PDMS HMF or a supported liquid membrane HMF.

A method of quantifying and measuring a trace level analyte in a sample is also provided, the sample being at least about 1.0 μL, the method comprising:

exposing a membrane interface device to a sample, such that the membrane interface device is bathed in the sample;

moving the sample over the membrane interface device;

delivering an acceptor phase to the membrane interface device via an acceptor phase carrier;

delivering the analyte to an ionization source and to a mass spectrometer; and obtaining an output, thereby quantifying and measuring the trace level analyte.

The measuring is direct.

The sample may be a biological sample.

The sample may be an environmental sample.

The method may further comprise rapid prescreening the sample and providing the sample for further analyzing.

The method may be for direct, in vivo or in situ monitoring of the biological and environmental samples.

In the membrane interface device, the miniature coaxial probe may be an immersion probe, the probe comprising a membrane interface coaxial with—an acceptor phase delivery capillary and for fluid communication with the acceptor phase, the membrane interface configured for bathing in the sample, under ambient pressure, the acceptor phase delivery capillary in fluid communication with the acceptor phase supply, the ionization source and the mass spectrometer.

In the method, the acceptor phase may include at least one of an internal standard, an acceptor phase ionization enhancer and an acceptor phase modifier.

The method may further comprise varying the acceptor flow rate.

In the method, the acceptor phase may include an acceptor phase modifier to provide a polymer inclusion membrane (PIM) PDMSHFM.

In the method, the membrane interface device may be an immersion probe.

BRIEF DESCRIPTION OF THE DRAWINGS

FIG. 4*a* shows one series of stopped acceptor flow data is shown. FIG. 4*b* shows average results from triplicate experiments; error bars represent two standard deviations.

FIG. 5*a* shows a full scan mass spectrum shown from m/z 150 to 350 from a sample of de-ionized water spiked with NA mixture. Potential assignment of the carbon numbers for the NA species is given above each peak cluster. FIG. 5*b* shows a MIMS trace for m/z 251 (e.g. $C_{16}H_{28}O_2$) from three sequential 440 ppb spikes of the NA mixture in de-ionized water (bottom) and undiluted river water (top). The observed signals were allowed to reach a stable level prior to the addition of the second and third spikes.

FIG. 6*a* shows a full scan mass spectrum of Athabasca NA present in a 1000× diluted heavy oil extraction process water sample at pH=4.5, with potential assignment of NA carbon number given over each peak cluster based on the work of Lo et.al. (Analytical Chemistry, 2003, 75, pp 6394), using a delicate membrane CP-MIMS comprising a 0.5 μm thick by 10 cm long PDMS composite HFM interface; FIG. 6*b* shows signal responses for selected m/z values from the injection of a sample of the process water in 1 L of re-circulated deionized water.

FIG. 19*a* shows a representative NA m/z SIM signal intensities for Alberta oil sands process waters (OSPW), ground water (GW) and surface water (SW) samples, as measured directly by CP-MIMS at pH 4. FIG. 19*b* shows a comparison of the direct quantitation of the NA profile mass spectrum for OSPW-2 by CP-MIMS (top panel) with reconstructed quantitative LC-MS/MS mass spectral data (bottom panel). Both analyses report NA in terms of pyrene butyric acid (PBA) equivalents, and illustrate the potential of CP-MIMS for direct, quantitative NA measurements.

FIG. 22*a* shows the full scan mass spectrum of sample at pH 4. FIG. 22*b* shows the full scan mass spectrum at pH 7. FIG. 22*c* shows the difference spectrum pH4-pH7. FIG. 22*d* shows the full scan mass spectrum of sample at pH 4 after 20 minutes of stirring with activated charcoal at a dose of 1500 mg/L. FIG. 22*e* shows the full scan mass spectrum at pH 7 after 20 minutes of stifling with activated charcoal at a dose of ~1500 mg/L. FIG. 22*f* shows the ion chromatogram of two representative naphthenic acid isomer class families at m/z=221 (lower scan) and 235 (upper scan). At 130 minutes, 6.2 ppm of a Merichem naphthenic acid mixture was spiked into a water sample. At 160 minutes, activated charcoal was added with stirring.

DESCRIPTIONS OF THE PREFERRED EMBODIMENTS

Figure 1:
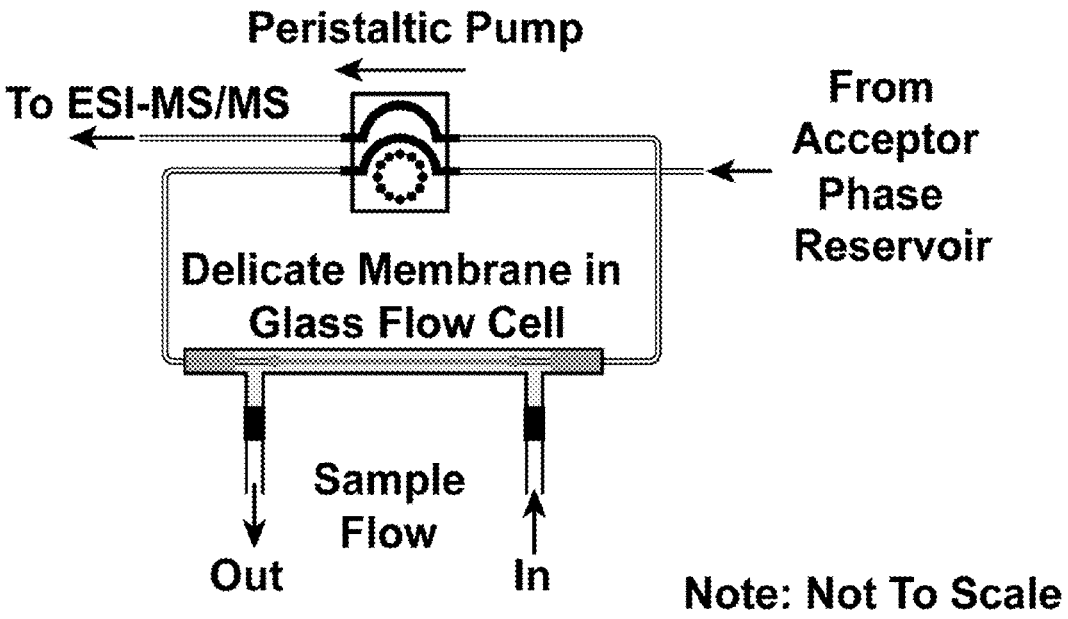
FIG. 1 is a schematic diagram of the delicate membrane CP-MIMS experimental apparatus of the present technology in continuous monitoring mode. The acceptor phase handling system includes a simultaneously matched pumping in and out delivery (SMPIOD) set-up using a twelve-roller miniature peristaltic pump.

Except as otherwise expressly provided, the following rules of interpretation apply to this specification (written description, claims and drawings): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, The terms "comprising," "having," "including," and "containing" are to be construed as open-ended terms (i.e., meaning "including, but not limited to,") unless otherwise noted.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

Volatile organic compounds. Volatile compounds (VOC) are molecules characterized by a relatively high vapor pressure, typically greater than about 1,000 Pa.

Semi-volatile compounds. Semi-volatile compounds (SVOC) are molecules with vapor pressures in the range of from about 0.1 Pa to about 1,000 Pa.

Non-volatile organic compounds. Non-volatile organic compounds are molecules with vapor pressures between about 0.1 Pa to about $10^{-6}$ Pa, or about 0.01 Pa to about $10^{-4}$ Pa or about $10^{-3}$ Pa and all ranges therebetween. Non-volatile organic compounds include for example, but not limited to naphthenic acids, organic acids, resin acids, fatty acids, natural organic matter, carboxylic acids, phenols, polyphenols, surfactants, substances of abuse, pharmaceutical compounds, metabolites, hormones, personal care products, flavorings, explosives and preservatives. They range in size from about 100 nl to about 1000 atomic mass units (amu), or about 100 to about 900 amu or about 300 to about 600 amu and all ranges therebetween.

Halogenated non-volatile organic compounds. Halogenated non-volatile compounds are compounds that contain one or more halogen atom. Unlike the non-volatile compounds, they may have a size greater than 1000 amu, or be as large as 2000 amu, depending upon the halogen(s) (iodine, bromine, chlorine and/or fluorine) embodied in their molecular structure.

Polar organic compounds. Polar compounds include for example, but not limited to naphthenic acids, organic acids, resin acids, fatty acids, natural organic matter, carboxylic acids, phenols, polyphenols, surfactants, substances of abuse, pharmaceutical compounds, metabolites, hormones, personal care products, flavorings, explosives and preservatives Charged compounds. Charged compounds are those compounds that contain ionizable functional groups and are present in ionic form in solution at ambient pH.

On-line measurements. On-line measurements provide an analytical signal by passing the sample through a device without the need for subsequent sample handling.

On-line, real-time analysis. On-line, real-time analysis refers to a method that allows for non-destructive analysis that, in turn, allows for repeated analysis in real-time. The samples can be re-circulated or continuously probed, and changes in the concentrations of measured molecules over time can be monitored.

Analyte refers to a particular molecule or group of molecular species of interest.

Permeate refers to a sample (analyte) after passage through a membrane introduction interface.

Delicate membrane. Non-limiting examples of delicate membranes are thin PDMS, composite PDMS/micro-porous polypropylene HFM and supported liquid membranes. Advantageously, the supported liquid membranes can include carriers to improve or allow analysis of specific analytes. The supported liquid membranes may be about 10 microns to about 250 microns thick, and all ranges therebetween. A thin membrane would be, for example, about 0.5 microns to about 100 microns, or about 5 microns to about 90 microns, or about 25 microns to about 75 microns, or about 35 microns or about 50 microns, and all ranges therebetween. The membranes may be sheets, hollow fibre or other conformations as would be known to one skilled in the art.

Rapid analysis. Rapid analysis in the context of the present technology is less than ten minutes and may be as fast as 0.1 minute, or 0.5 minute, or two minutes and all ranges therebetween.

Consistent acceptor phase flow rate. Consistent flow rate means that the flow rate does not change during the analysis. The rate can be selected from a range of about 100 nl to about 1000 μL/minute and all ranges therebetween, but is set at a given rate.

Consistent acceptor phase flow pressure through the membrane. Consistent flow pressure means that the flow pressure does not change during the analysis. The pressure can be selected from a range of about 90 kPa to about 110 kPa, but is set at a given pressure.

Direct measurement. Direct measurement means that the sample is measured without cleanup, pre-concentration and/or chromatographic separations prior to analysis.

Trace level analytes. Trace level analytes in the context of the present technology refers to polar, non-volatile analytes in the concentration range of parts-per-trillion up to parts-per-million.

Membrane interface device. In the context of the present technology, membrane interface device is any unit that holds a membrane that can be in contact with the sample on one side and an acceptor phase carrier on the other such as a flow cell, an immersion probe, a J probe, a miniature coaxial probe, each having a delicate membrane CP-MIMS.

Acceptor phase carrier. In the context of the present technology, a carrier is any article that can deliver acceptor phase to the membrane interface device, for example, but not limited to a capillary, a needle, or a hypodermic tube.

DETAILED DESCRIPTION

Apparatus and Materials

The mass spectrometer used for the presented work was a triple quadrupole system (Micromass Quattro Ultima LC, Waters-Micromass, Altrincham, UK) with an ESI probe and Z-spray™ source. Nitrogen gas (UHP grade, 99.999% pure) was supplied from a liquid nitrogen Dewar and argon collision gas (UHP grade) was supplied from a compressed gas cylinder (Praxair Inc., Nanaimo, BC, Canada). The base pressure in the vacuum system was ~$9\times10^{-6}$ Torr. Negative ion mode experiments used an ESI capillary voltage of −3 kV. The desolvation gas flow rate was 750 L/hr at 300° C. and the cone curtain gas flow rate was set to 60 L/hr. For MS/MS experiments, the collision cell was maintained at a pressure of 3 mTorr, collision energies and MS parameters are given in Table 1.

The CP-MIMS interface was based on a flow-over capillary hollow fiber membrane (HFM) design described previously in Rapid Communications in Mass Spectrometry, 2011, 25, pp 1141, incorporated herein in its entirety and shown in FIG. 1. Several PDMS HFM substrates were examined, including 215 μm thick HFM material (0.51 mm ID, 0.94 mm OD, 10 cm length, Dow Corning Silastic® tubing, Midland, Mich., USA) ("standard" HFM), composite PDMS/porous polypropylene HFM (263 μm OD, 209 μm ID, 10 cm length, 0.5 μm thick PDMS membrane, neoMecs Inc. Eden Prairie, Minn., USA), and very thin, unsupported PDMS HFM (237 μm OD, 167 μm ID, 5 cm length, 35 μm PDMS thickness, Permselect®, MedArray Inc. Ann Arbour, Mich., USA;). The smaller diameter composite and thin PDMS HFM were constructed by mounting them between two short lengths of stainless steel hypodermic tubing (22 gauge, 0.71 mm OD, 0.51 mm ID, Vita Needle Inc., Needham, Mass., USA) using high vacuum epoxy (Kurt J. Lesker Company, Clairton, Pa., USA) as a potting compound. Next, the HFM assemblies were mounted inside single piece ¼" OD, in-house constructed glass flow cells, also by using high vacuum epoxy to pot the hypodermic tubing at each end. The exposed ends of the hypodermic tubing were connected to 1/16" PEEK® tubing (Chromatographic Specialties Inc., Brockville, ON, Canada) using low dead volume stainless steel unions (VICI Valco, Brockville, ON, Canada). The acceptor phase reservoir was connected to the CP-MIMS interface using 0.76 mm ID PEEK® tubing, while acceptor phase was drawn from the interface using 0.25 mm ID tubing. To provide a slight back-pressure for stable ESI spraying, the final length of PEEK® tubing leading from the acceptor phase pump to the ESI source was 0.07 mm ID. To create an even flow of acceptor phase through the HFMs examined, the acceptor phase was urged using SMPIOD, at 200 μL/min through their lumens and then delivered to the ESI source using a small, low pulsation, 12-roller multichannel peristaltic pump (Model MP2, Elemental Scientific, Omaha, Nebr., USA) equipped with two 0.51 mm ID Viton® pump tubes (Elemental Scientific). For consistency with previously published work, the 215 μm thick PDMS HFM was operated at a 500 μL/min acceptor phase flow rate. The SMPIOD reduces pressure on the membrane and therefore decreases the potential for damage to the delicate membrane. It was found that the normal operating conditions of CP-MIMS damaged thin PDMS and supported liquid membranes, whereas SMPIOD did not lead to damage.

A schematic diagram of the experimental apparatus is given in FIG. 1. The pump was controlled through the manufacturer-supplied interface hardware and software using the mass spectrometer data collection computer. A 500 mL high-performance liquid chromatography (HPLC) glass reservoir (Sigma Aldrich, Oakville, ON, Canada) was used to supply an acceptor phase of HPLC Grade methanol (Fisher Scientific, Ottawa, ON, Canada), which was degassed with helium gas sparging (UHP grade, 99.999% pure, Praxair) before and during operation.

The flow cell allows for maintenance of sample integrity, allowing for non-destructive analysis. Coupling of the flow cell with a recirculation system then allows for recirculation of the sample, which in turn allows for repeated analysis. Repeated analysis in turn allows for tracking of time dependent changes in a sample. Note that there is no sample injection loop or acceptor phase injection loop. This configuration allows for constantly flowing the acceptor phase with analytes that permeate through the membrane to the mass spectrometer.

Reagents, solvents and target analytes were obtained from a variety of suppliers and were ACS grade or better unless otherwise noted. Abietic acid (Tech. grade, 70%), triclosan (5-chloro-2-(2,4-dichlorophenoxy)phenol), 2,4,6-trichlorophenol, nonylphenol, estrone (3-hydroxy-13-methyl-6,7,8,9,11,12,13,14,15,16-decahydrocyclphena[a]-phenanthren-17-one), gemfibrozil (5-(2,5-dimethylphenoxy)-2,2-dimethyl-pentanoic acid) were all obtained from Sigma Aldrich. Table 1 lists target analytes studied, relevant MS scan parameters, and pertinent physical properties. A commercially available naphthenic acids mixture (Merichem Company, Houston, Tex., USA) that has been characterized by others was used for these studies, in addition to naphthenic acid mixtures and pyrene butyric acid from Sigma-Aldrich Canada. Natural water samples were collected from a typical muskeg river drainage in the Alberta Oil Sands bitumen deposit area (AB, Canada), with 21 ppm dissolved organic carbon (DOC) and pH=6.3. Steam assisted gravity drainage (SAGD) heavy oil extraction process water samples (Alberta Oil Sands) had a measured pH of 11.3 and a specific conductivity of 110,0000/cm. Because of their highly contaminated nature, the process water samples were diluted and the pH was adjusted to ~pH 4.5 prior to measurements using 6M HCl (Fisher Scientific).

Photolysis experiments were carried out in a Rayonet photochemical reactor equipped with 8×254 nm lamps (Model RPR 100, Southern New England UV Co., Branford, Conn.) and a 700 mL quartz reaction flask with a 10° C. immersion cold finger for sample cooling. Reactions were monitored by re-circulating 1 L of aqueous (DI) solution containing 0.7 mM $H_2O_2$ (Fisher Scientific) in a closed loop through the MIMS interface using ¼" O.D. Teflon tubing using a peristaltic pump (model 77200-62 Masterflex Easy-Load II with LS-25 Viton Tubing, Cole-Parmer, Vernon Hills, Ill., USA). The reaction mixture was flowed through the system at a fixed rate of 250 mL/min. The methanol acceptor phase was handled as described above.

Aqueous samples and standards were maintained at 30±1° C. using a constant temperature water bath (model BM100; Yamato Scientific, Santa Clara, Calif., USA) and were re-circulated through the various CP-MIMS interfaces using a peristaltic pump (model 77200-62 Masterflex Easy-Load II with LS-25 Viton Tubing, Cole-Parmer, Vernon Hills, Ill., USA) at 250 mL/min. The 500 mL glass reservoir used was constructed in-house, and had Teflon™ lined septum port for injecting aliquots of standards and sample spikes. All standard solutions were prepared in HPLC grade methanol, with gas tight analytical syringes (Hamilton Company, Reno, Nev., USA). Aqueous samples were re-circulated in a closed loop system constructed from short lengths of 0.25" OD Teflon™ tubing (Cole-Parmer). For all experiments, the membrane was flushed with deionized water (DI, Model MQ Synthesis A10, Millipore Corp., Billerica, Mass., USA) between runs until stable baseline signal was observed. Signals were characterized based on their background-subtracted intensities at steady state for analytical calibration and by their 10-90% response times. Detection limits presented are based on signal-to-noise (S/N) ratio of three.

EXAMPLE 1

Acceptor and Sample Flow Rate

The influence of both acceptor and donor (sample) flow rates on the sensitivity and response for 50 ppb aqueous solutions of gemfibrozil with delicate membrane CP-MIMS using the composite PDMS membrane interface was determined. For all work presented the aqueous sample was maintained in a water bath at 30° C. The acceptor phase fluid handling system was optimized by using SMPIOD, where a twelve roller peristaltic pump (two pumping channels) was used to simultaneously drive the flow of liquid into and out of the membrane at the same pressure and flow rate. Initial studies using the in-line acceptor phase micro pump or a single channel 12 roller peristaltic pump showed that the delicate membranes were easily ruptured by the (slight) pulsing of the acceptor phase flow and/or pressure differences across the length of the HFM. In order to overcome this deficiency, SMPIOD was accomplished by reversing one of the pump tube configurations in the peristaltic pump head, and resulted in simultaneously matched pumping in and out of the delicate HFMs. This ensured a constant and even flow of acceptor phase, through these fragile HFM interfaces to the electrospray source. While a single pump need not be used, in the situation where two pumps are used, they must be closely matched for both flow rate and pressure.

Figure 2:
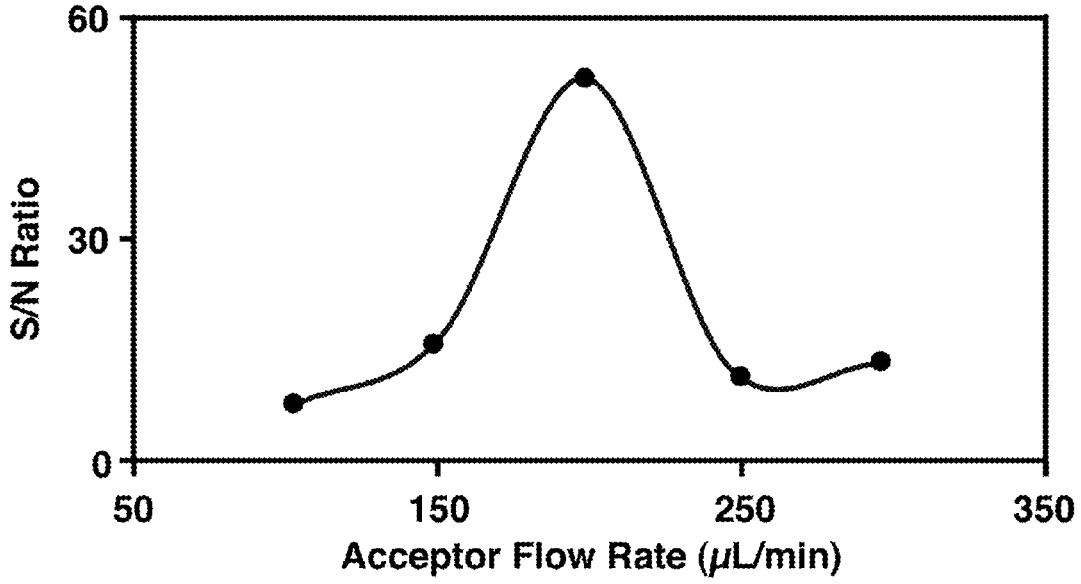
FIG. 2 is a plot of signal-to-noise (S/N) ratio versus delicate membrane CP-MIMS acceptor flow rate for signals obtained from 50 ppb aqueous solutions of gemfibrozil using a 10 cm long (0.5 μm thick PDMS) composite PDMS/polypropylene HFM interface. At 200 μL/min an optimum in S/N ratio occurs, which was used for all subsequent work.

FIG. 2 illustrates that the signal-to-noise ratio (S/N) is optimum at an acceptor phase flow of 200 μL/min. At acceptor flows lower than 100 μL/min, peristaltic pump pulsations became more pronounced, leading to erratic signals. At higher acceptor phase flows, S/N decreased, but so too did the absolute signal intensity, due to analyte dilution in the increased flow. During this study, a constant response time for gemfibrozil ($t_{10\text{-}90\%}$=0.8 min) was found for all flow rates tested (100-300 μL/min). Without being bound by theory, this observation demonstrates that the response times observed were mainly due to membrane transport, rather than an uncharacterized diffusional broadening after the membrane. Thus, an acceptor flow rate of 200 μL/min was used for all subsequent experiments, however, as would be known to one skilled in the art, any flow rate between about 100 to about 300 μL/min, and all ranges therebetween could be used. Varying the rate of aqueous sample (donor phase) flow through the CP-MIMS interfaces from 200 to 300 mL/min at ambient pressure (e.g. 101 kPa) did not alter the observed signal intensities, however above 300 mL/min, significant signal variation was observed. Without being bound to theory, this was attributed to the substantially increased 'strumming' of the fragile HFM in the sample flow within the interface itself, caused the increased flow turbulence at higher flow rates (this was directly observable through the walls of the glass interface casings). To eliminate this signal noise and to minimize the potential for membrane ruptures, an aqueous sample flow rate of 250 mL/min was used for all subsequent experiments, however, as would be known to one skilled in the art, any flow rate between about 10 to about 300 mL/min and all ranges therebetween could be used.

Quantitation, Signal Response Times and Detection Limits

The analytical performance of the various delicate membrane CP-MIMS interfaces was evaluated for a variety of non-volatile, polar target analytes (see Table 1). Analytes for this study were selected for their environmental and/or biological significance, as well as for their relatively poor analytical performance with GP- MIMS. The low vapour pressures (ranging from 1 to $10^{-8}$ Pa) and polar character of the target analytes in this study result in impractically long response times and poor analytical sensitivity with GP-MIMS operated at ambient temperatures.

Detection limits and signal response times for each PDMS HFM interface were determined for each of the target analytes in aqueous solutions and are summarized in Table 2. The average steady state analytical signals used for this work were found by averaging >100 data points obtained during the measurement of a known aqueous standard. Response times and detection limits (S/N=3) for the target analytes are reported for replicate experiments (n=3 to 5). As illustrated in Table 2, the composite PDMS HFM had dramatically decreased response times that were in general ~10× faster for the less volatile and more polar analytes studied. MIMS signal response times reflect the time it takes for the analyte signal to approach a steady state flux across the membrane, in response to a step function increase in upstream (sample) concentration. Without being bound to theory, these response times are largely governed by the rate of diffusion of the analyte through the membrane, which can be related to the analyte's molar volume. In general, smaller analytes will permeate polymer membranes faster than larger ones. Some of the target analytes do exhibit fairly long response times with the 'standard' PDMS HFM (215 μm thick PDMS), such as abietic acid ($t_{10\text{-}90\%}$=16.5 min). The response time for abietic acid is shortened by approximately a factor of ten when the composite PDMS HFM (0.5 μm thick PDMS) is used ($t_{10\text{-}90\%}$=1.6 min). Similar response time improvements were observed for all target analytes measured with this interface (Table 2). This may have a significant advantage for the monitoring of relatively fast changes in chemical concentrations, or for the rapid measurement of a large number of samples. Without being bound to theory, to study 'dynamic' chemical processes, the rate at which the analyte permeates the membrane must be faster than the rate of the change in concentration so that no information is lost. Applications could include following the progress of chemical reactions, chemical process control, the on-line environmental monitoring of (less volatile) contaminant plumes. In addition to changes in the bulk concentration, the technique allows for monitoring changes in the compositional distribution of compounds. This information is useful in monitoring the extent of chemical weathering, the effectiveness of certain processes (both natural and industrial) and can be applied to source identification. The 35 μm thick PDMS HFM showed modest improvements in response time, but its' analytical performance (e.g. detection limits) was possibly diminished by its shorter length (5 cm versus 10 cm), limited by the membrane stock available at the time of the study.

Figure 3:
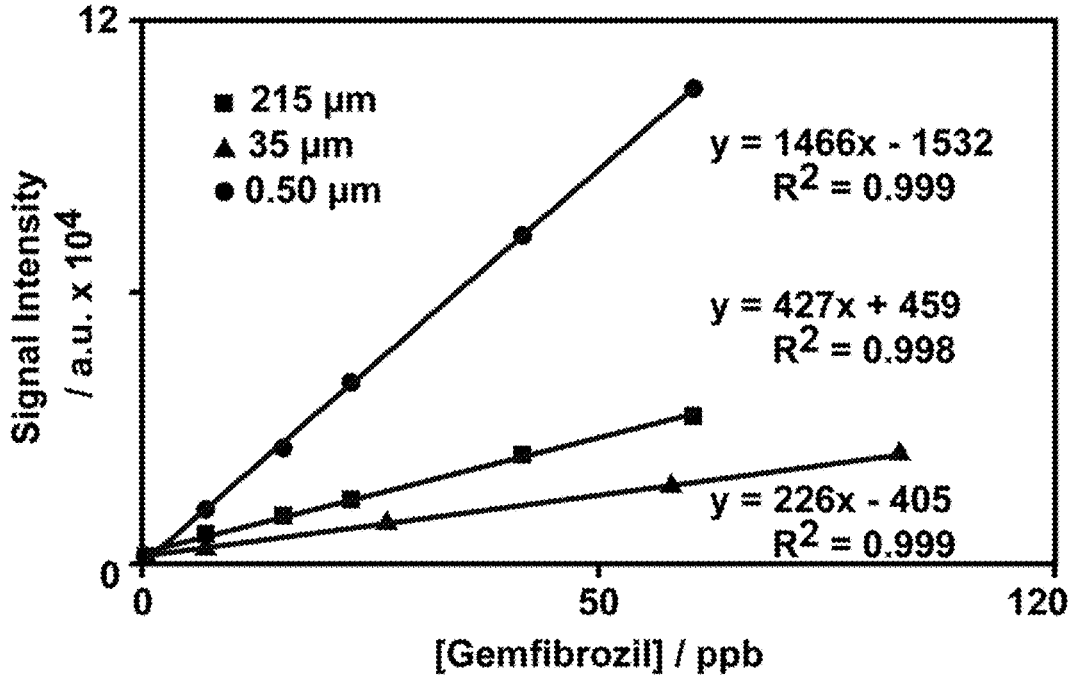
FIG. 3 is a representative calibration curve for gemfibrozil analyzed by delicate membrane CP-MIMS with a 10 cm long composite PDMS/polypropylene HFM interface (0.5 pm thick PDMS) or a thin (35 μm thick) PDMS HFM, in comparison to CP-MIMS using a 215 μm thick PDMS HFM. Similar calibration linearity was also observed for other target analytes.

FIG. 3 shows a typical ppb level calibration curve obtained for gemfibrozil using the three delicate CP-MIMS interfaces, showing good linearity. All else being equal, a greater flux is expected as membrane thickness decreases, resulting in a faster response time and greater signal intensity, since permeation is inversely dependent on membrane thickness. However, for the analytes studied here the composite HFM generally equaled the 'standard' PDMS HFM in terms of sensitivity. The composite HFM affords a higher analyte flux, as is shown by its dramatically decreased response times (Table 2), but its lower outer surface area, compared to the 'standard' PDMS HFM, opposes this effect. The thin PDMS HFM, which was available only in 5 cm lengths, was much less sensitive than the others, also likely due to less exposed surface area for analyte extraction from the donor phase. Different optimal acceptor phase flow rates for the delicate membrane interfaces versus the 'standard' interface may also be a confounding factor. Gemfibrozil shows a dramatically increased sensitivity with the composite HFM, which may be due to its high ionization efficiency in conjunction with the higher flux afforded by the thin PDMS layer. The sensitivity of the composite PDMS HFM rivals or exceeds the 'standard' PDMS interface in all cases except for nonylphenol, which may be due to more efficient extraction of this analyte into the membrane with the highest surface area since it quite hydrophobic (large $K_{ow}$) as compared to the other analytes considered here. The detection limits of these CP-MIMS systems are governed by enrichment at the membrane level, which is driven by analyte specific solubility in the membrane phase, as well as by the ESI ionization efficiency. For the composite PDMS HFM detection limits ranged from 40 pptr for gemfibrozil and 2,4,6-trichlorophenol to 3 ppb for estrone. The thin (polymer only) PDMS interface exhibits a similar trend with detection limits of 200 and 500 pptr for gemfibrozil and 2,4,6-trichlorophenol, respectively, to 12 ppb for estrone. Thus, without being bound to theory, the detection limit trend seems more likely to be the result differing ionization efficiencies in ESI negative ion mode.

EXAMPLE 2

Stopped Acceptor Flow Mode

Figure 4A:
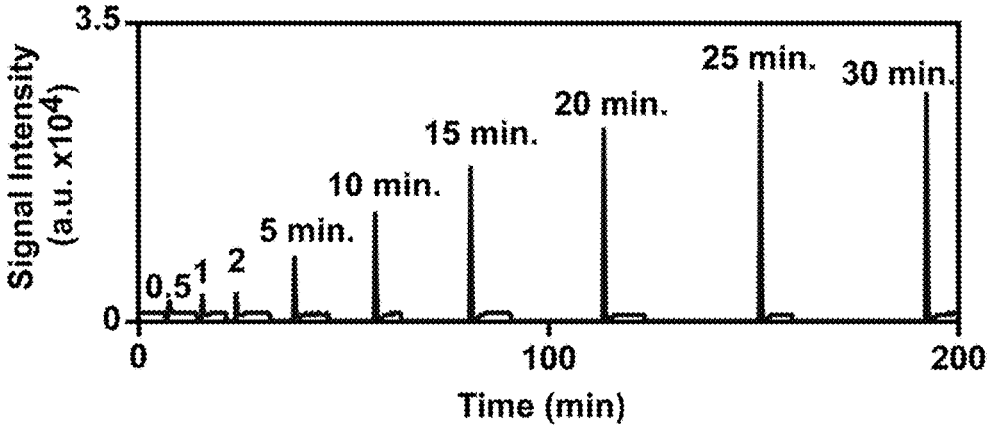
FIGS. 4*a* and 4*b* show the result of stopped acceptor phase enrichment of gemfibrozil by delicate membrane CP-MIMS with a 10 cm long (0.5 μm thick PDMS) composite PDMS/polypropylene HFM interface. This experiment was performed during the recirculation of an aqueous 1 ppb gemfibrozil solution.
Figure 4B:
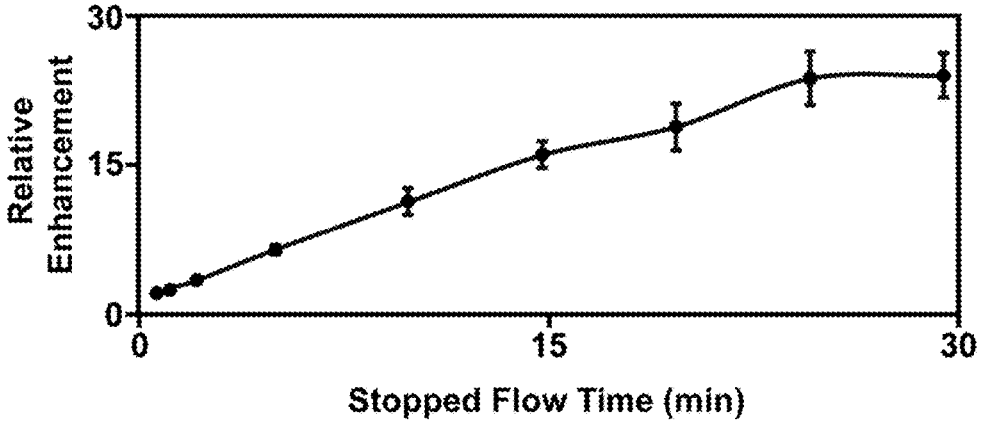

As described previously, the delicate membrane CP-MIMS interface can be operated with a continuous flow of acceptor phase (e.g. continuous monitoring mode) or with a static acceptor phase in the membrane for a period of time to increase analytical sensitivity (stopped flow mode). The relative signal enhancements for stopped flow mode over continuous monitoring mode was determined using the composite 0.5 μm thick PDMS/polypropylene interface for continuously re-circulated 1 ppb aqueous solutions of gemfibrozil. FIG. 4*a* illustrates the intensity of the gemfibrozil signal as a function of acceptor phase stopped flow time. FIG. 4*b* shows the average values of signal enhancement for three replicate experiments. The results of the stopped flow mode operation with the composite membrane show improvements upon previously reported findings with the 215 μm thick PDMS CP-MIMS HFM interface. The enrichment increases with acceptor phase stopped flow time giving 28× signal enhancement when the acceptor phase is stopped for 25 minutes.

EXAMPLE 3

Direct, On-Line Measurement of Naphthenic Acids in Complex Samples

To demonstrate the potential utility of delicate membrane CP-MIMS systems for trace level the continuous on-line monitoring of trace levels of low volatility analytes, the composite PDMS HFM based system was used to measure mixtures of naphthenic acids directly in deionized water and complex sample matrices. Naphthenic acids (NA) are natural components found in heavy crude oil, and are extracted and concentrated in the aqueous wastes generated during the various processes used to separate heavy crude oil from bitumen. NA mixtures can be found in total concentrations up to approximately 100 mg/L in bitumen extraction waste water tailings ponds and surface waters. These compounds are a highly complex mixture of alkyl substituted linear and cycloaliphatic carboxylic acids, which have a general molecular formula of $C_nH_{2n+Z}O_x$, where n is the carbon number (typically 8-30), Z is the hydrogen deficiency and x is the number of oxygen's (typically 2-5).

Figure 5A:
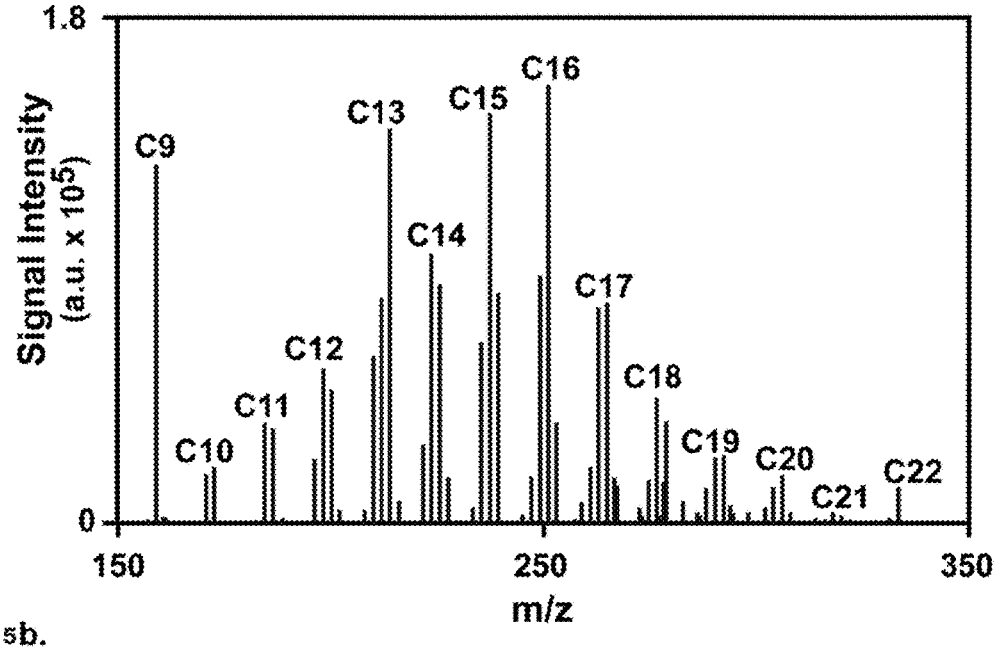
FIGS. 5*a* and 5*b* show measurement of an industrial mixture of naphthenic acids (NAs) (Merichem) by delicate membrane CP-MIMS using a 10 cm long (0.5 μm thick PDMS) composite PDMS/polypropylene HFM interface.
Figure 5B:
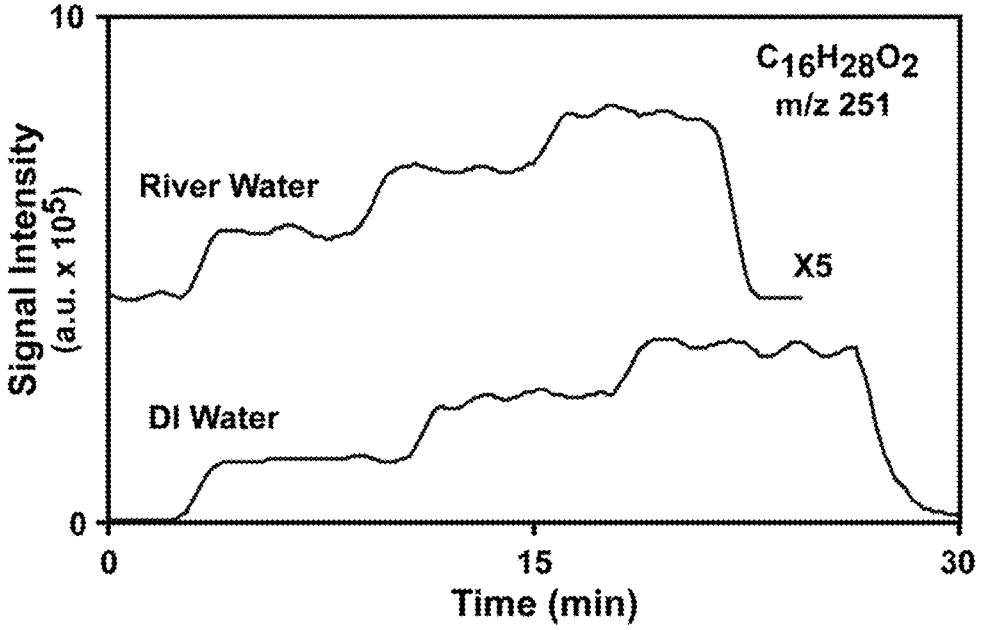
Figure 6A:
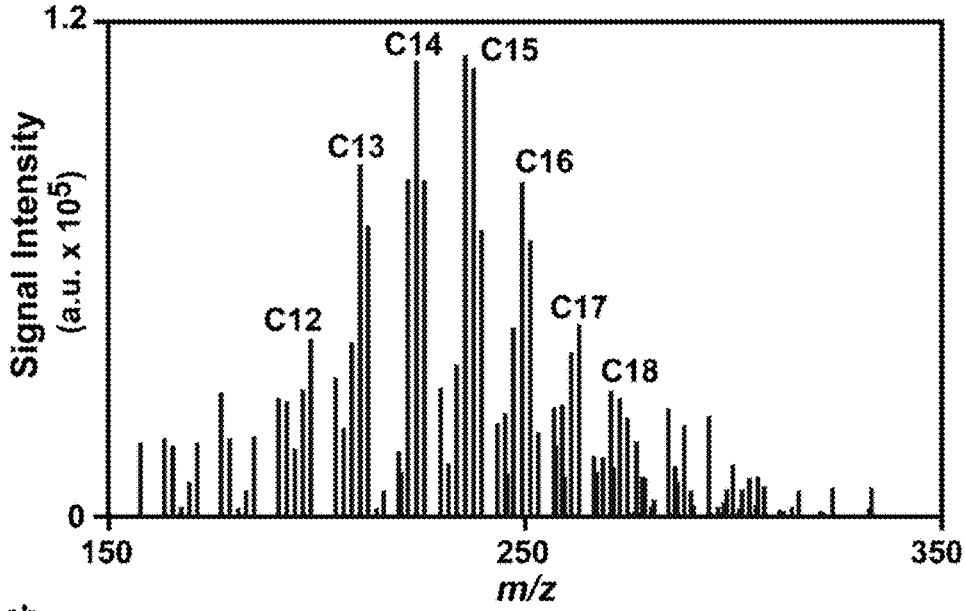
FIGS. 6*a* and 6*b* show a full scan mass spectrum and signal response times.
Figure 6B:
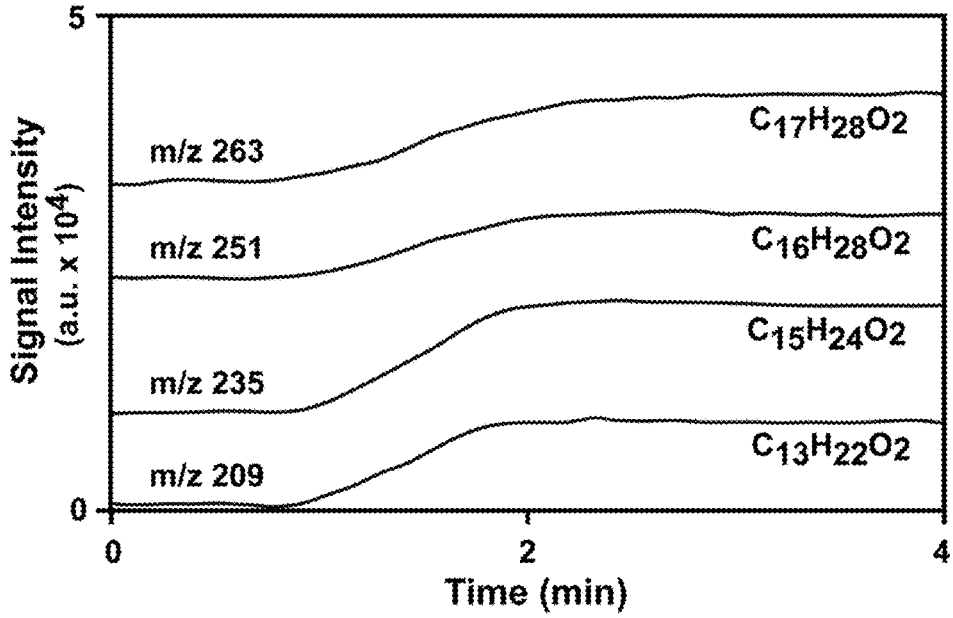

To demonstrate the potential utility of the delicate membrane CP-MIMS interfaces for the measurement of NA real environmental samples, several experiments were conducted. Aqueous solutions of a previously characterized NA mixture (Merichem) at ppb total levels were measured using the 0.5 μm thick PDMS composite HFM interface in both DI water and in river water at ppb concentrations. The Merichem spiked de-ionized water was ~pH 5, and when this sample was further acidified (by addition of 6M HCl) to ~pH 4, the signals for NA m/z values increased, suggesting that a larger fraction of these acids were protonated, allowing more of them to permeate the membrane and be detected. FIG. 5*a* shows the negative ion full scan mass spectrum for the Merichem naphthenic acids mixture at ~pH 4 in DI water (440 ppb total concentration by mass), exhibiting clusters of peaks separated by 14 m/z units, each corresponding to naphthenic acid species with different carbon numbers. SIM traces for m/z 251 (e.g. $C_{16}H_{28}O_2$) are given in FIG. 5*b* for three consecutive ppb level spikes of Merichem mixture in continuously re-circulated DI water and river water (Alberta, Canada). It is roughly estimated that each represents at maximum <10% of the total mixture (in most cases, much less). Analysis of the S/N ratios for the signals obtained for 440 ppb Merichem NA in DI and river water is given in Table 3, along with average signal response times. With the estimated concentration at an upper limit of 44 ppb/component, this would translate into estimated S/N=3 detection limits of ca. 0.5-10 ppb for any individual component based on the full scan experimental data presented in Table 3. With improved MS scan parameters (e.g. SIM or MS/MS) it is anticipated the detection limits would be greatly improved. The signal rise times range from 0.7-1.4 minutes, suggesting at least for the species detected, the delicate membrane CP-MIMS response times would allow rapid screening methods for NA as well as the continuous real-time monitoring of changing NA concentrations, such as would be observed during cleanup, industrial processing, remediation or destruction/reclamation processes. For comparison purposes and as an authentic environmental NA sample, Athabasca oil sands NA were also measured in a 1000× diluted heavy oil extraction process water sample, and a full scan mass spectrum is shown in FIG. 6*a*. Signal rise times for the observed m/z values (FIG. 6*b*) are consistent with the data obtained for the Merichem NA sample presented in Table 3.

EXAMPLE 4

Figure 7A:
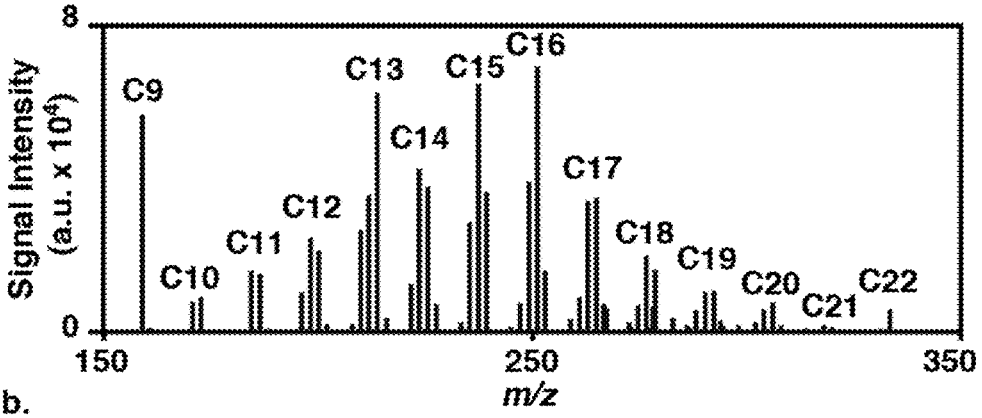
FIGS. 7*a* shows a full scan mass spectrum for 900 ppb of a NA mixture (Merichem) in de-ionized water using a delicate membrane CP-MIMS.
Figure 7B:
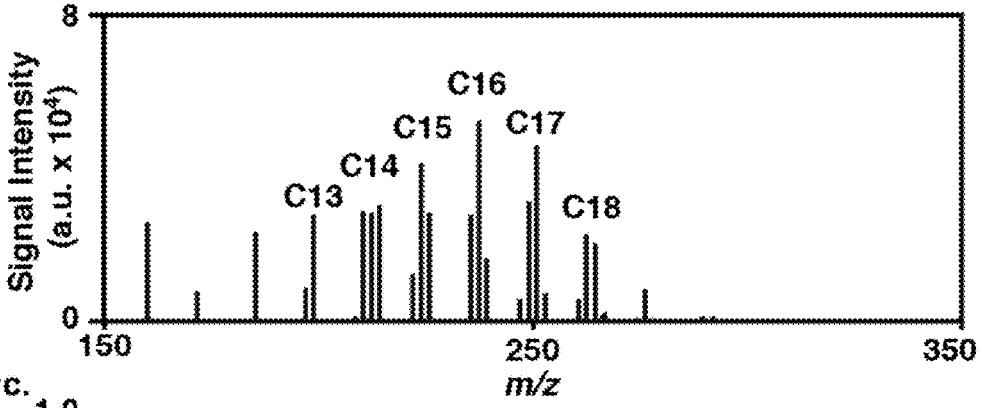
FIG. 7*b* shows a full scan mass spectrum for 900 ppb of the same NA mixture after 100 minutes of irradiation at 254 nm in the presence of 0.7 mM $H_2O_2$ monitored by delicate membrane CP-MIMS using a 0.5 μm by 10 cm long composite PDMS membrane interface.
Figure 7C:
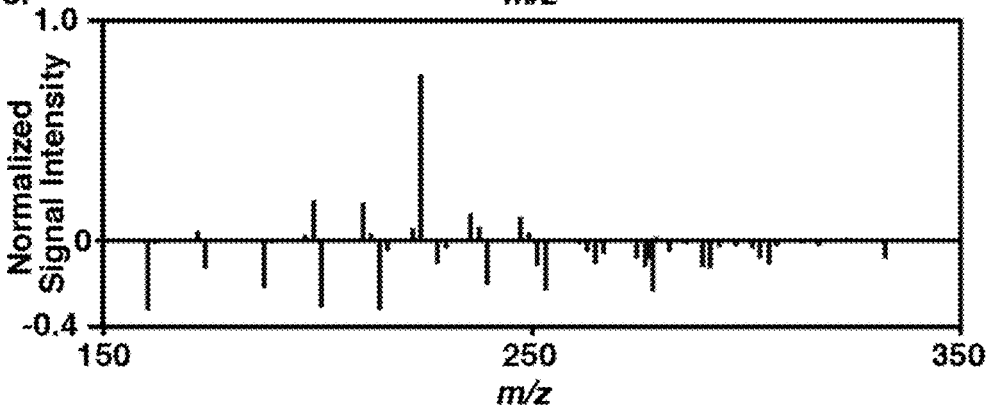
FIG. 7*c* shows the difference between the scan of FIGS. 7*b* and 7*a* normalized to the intensity of the base peak in FIG. 7*b*.

In the continuous flow mode, both the sample and acceptor phases are continuously flowing which permits following the concentration of a dynamic system, in which changes in the concentration of analyte can be monitored over time. To illustrate the potential for rapid screening, on-line applications of delicate PDMS interfaces, a photochemical destruction study was conducted in which a 900 ppb Merichem NA sample in DI water was irradiated with 254 nm UV photons in the presence of 0.7 mM $H_2O_2$. The sample was measured at the beginning and the end of the experiment using the composite 0.5 μm PDMS HFM interface (FIG. 7). On inspection of the full scan mass spectra obtained before irradiation (FIG. 7.*a*.) and after 100 minutes of UV/$H_2O_2$ treatment (FIG. 7.*b*.), the profile has shifted slightly to smaller m/z values and contains less observed species, suggesting partial destruction of the NA species present. The difference mass spectrum (FIG. 7.*c*.) illustrates that there are greater net losses of the higher molecular weight NAs, although there are reductions of various NA m/z signals across the profile. The use of CP-MIMS to make direct, rapid high sensitivity profile determinations allows for potential NA source fingerprinting, and could be used to indicate sample aging, weathering or other processes without the need for sample handling and cleanup, that would be required for trace level samples using direct infusion strategies.

EXAMPLE 5

The experiments of Example 1 will be repeated using a 10 cm long 35 μm thick PDMS HFM. Detection limits and signal response times for each PDMS HFM interface will be determined for each of the target analytes in aqueous solutions. The average steady state analytical signals used for this work will be found by averaging >100 data points obtained during the measurement of a known aqueous standard. Response times and detection limits (S/N=3) for the target analytes will be reported for replicate experiments (n=3 to 5). The composite PDMS HFM has dramatically decreased response times that in general are ~10× faster for the less volatile and more polar analytes studied, as compared to the "standard membrane". Similarly, the thin membrane (35 μm thick PDMS HFM) will show much decreased response times. For the composite PDMS HFM detection limits will range from 40 pptr for gemfibrozil and 2,4,6-trichlorophenol to 3 ppb for estrone. Similar, if not better ranges will be found for the 10 cm long 35 μm thick PDMS HFM interface.

EXAMPLE 6

The experiments of Example 2 will be repeated using a 10 cm long 35 μm thick PDMS HFM and the composite 0.5 μm thick PDMS/polypropylene interface. The results of the stopped flow mode operation with the composite membrane will show improvements upon previously reported findings with the 215 μm thick PDMS CP-MIMS HFM interface for both membrane systems.

EXAMPLE 7

Direct, on-line measurement of naphthenic acids in a complex samples will be conducted using a 10 cm long 35 μm thick PDMS HFM and the composite 0.5 μm thick PDMS/polypropylene interface. To demonstrate the potential utility of the delicate membrane CP-MIMS interfaces for the measurement of NA real environmental samples, several experiments will be conducted. Aqueous solutions of a previously characterized NA mixture (Merichem) at ppb total levels will be measured using the 0.5 μm thick PDMS composite HFM interface and the 35 μm thick PDMS HFM in both DI water and in river water at ppb concentrations. The estimated S/N=3 detection limits of ca. 0.5-10 ppb for any individual component will be reported. The signal rise times range will range from 0.7-1.4 minutes, suggesting at least for the species detected, the delicate membrane CP-MIMS response times will allow rapid screening methods for NA as well as the continuous real-time monitoring of changing NA concentrations, such as could be observed during cleanup, remediation or destruction/reclamation processes. For comparison purposes and as an authentic environmental NA sample, Athabasca oil sands NA will also be measured in a diluted heavy oil extraction process water sample. Signal rise times for the observed m/z values will be consistent with the data obtained for the Merichem NA sample presented in Table 3.

EXAMPLE 8

To illustrate the potential for on line real time monitoring applications using the delicate membrane PDMS interfaces, a photochemical destruction study was conducted in which a 900 ppb Merichem NA sample in DI water was irradiated with 254 nm UV photons in the presence of 0.7 mM $H_2O_2$, using the composite PDMS HFM interface and the 35 μm thick PDMS HFM interface. On inspection of the full scan mass spectra obtained before irradiation and after 100 minutes of UV/$H_2O_2$treatment, shifts in the profile will be measurable.

EXAMPLE 9

Studies will be conducted to demonstrate that the 35 μm thick PDMS HFM and the composite 0.5 μm thick PDMS/polypropylene interface can be used in delicate membrane CP-MIMS with SMPIOD to study large molecules. It will be found that application of additional driving forces (e.g., thermal, electrical, chemical or pH gradients) will allow for analysis of larger molecules.

EXAMPLE 10

For continuous on-line measurements for trace level analytes, such as encountered in, for example, but not limited to bioanalytical measurements in blood or urine samples, a miniature CP-MIMS probe was developed. This can be dipped or immersed or otherwise introduced in the sample to be analyzed. Preferably, the sample is adequately mixed by stirring or agitation (for example, but not limited to sonicating, bubbling, jiggling, squirting, spraying, flowing or rocking) during the measurement, the flow rate could be 0 for direct immersion of the interface probes in the sample.

The acceptor phase flow characteristics of the miniature CP-MIMS coaxial membrane probe were designed to facilitate minimal dead volumes within the probe itself while simultaneously maximizing the linear velocity of the acceptor phase on the permeate side of the membrane.

Figure 17:
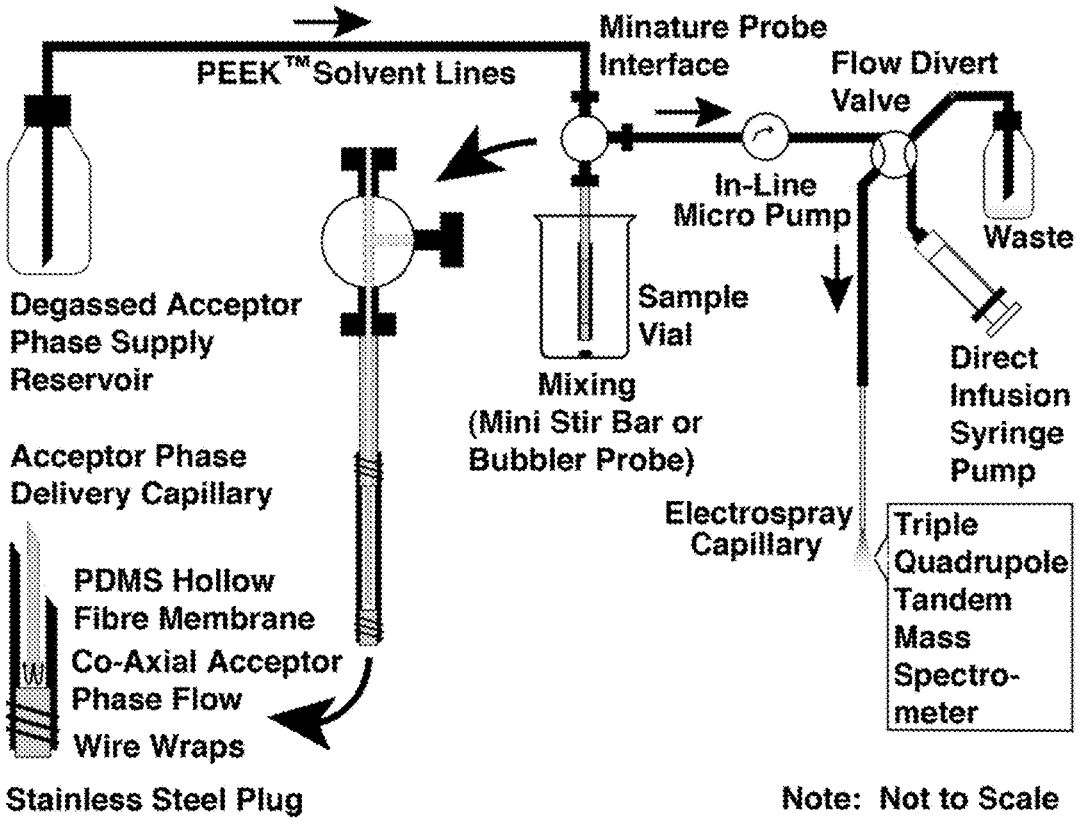
FIG. 17 shows the delicate membrane coaxial immersion probe system of the present technology.

The working PDMS HFM dimensions used were 0.94 mm o.d., 0.51 mm i.d. and 20 mm long (Silastic brand; Dow Corning, Midland, Mich., USA). The membrane was 215 μm thick. The outer body of the probe stem was constructed from 22 gauge stainless steel hypodermic stock (Vita Needle Co., Needham, Mass., USA). The coaxially arranged acceptor phase delivery capillary was made from a short length of deactivated Siltek® capillary column (0.25 mm ID, 0.37 mm OD, Restek Corp., Bellefonte, Pa., USA). The membrane was mounted over the hypodermic probe stem and a stainless steel end plug using hexane (ACS grade, Fisher Scientific, Ottawa, Ontario, Canada) as a membrane-swelling agent. A few turns of 30 gauge copper wire (GC Electronics Ltd, Rockford, Ill., USA) over the membrane at the end plug and on the probe stem were used to ensure that the membrane was not dislodged during preliminary testing and subsequent use. The probe was assembled using a 0.75 mm bore stainless steel tee union for 1/16" diameter tubing (Valco Instruments Co. Inc., Brockville, ON, Canada), which also acted as a connection point for acceptor phase delivery and its subsequent transport to the mass spectrometer. A schematic diagram of the apparatus is given in FIG. 17.

For this work, HPLC grade methanol (Fisher Scientific) was used as supplied, and was degassed using helium sparging (UHP Grade, Praxair Inc., Nanaimo, BC, Canada) when employed as an acceptor phase. Acceptor phase delivery to the membrane probe assembly was accomplished using 1/16" PEEK™ tubing (0.75 mm ID, Chromatographic Specialties, Brockville, ON, Canada), while acceptor phase transfer to the mass spectrometer used a smaller ID (0.25 mm) piece of PEEK™ tubing from the same supplier. The diameter of the tube used between the probe and the ESI source was intentionally smaller than the acceptor phase delivery tube to minimize any unintended dilution or signal broadening effects. Preliminary work showed that minor changes in the length of the tubing from the probe to the mass spectrometer did not adversely affect the signal rise time or maximum intensities observed. A triple quadrupole tandem mass spectrometer equipped with a low dead volume in-line micro-pump and ESI was used, as described above.

Target analytes included phenol, 2-chlorophenol, 2,4-dichlorophenol, 2,4,6-trichlorophenol, triclosan (2,4,4'-trichloro-2'-hydroxydiphenyl ether), gemfibrozil (5-(2,5-dimethylphenoxy)-2,2-dimethylpentanoic acid) and nonylphenol (Sigma Aldrich, Oakville, ON, Canada). The chlorophenols and nonylphenol are representative drinking water contaminants, triclosan is an antifungal/bacterial agent shown to have endocrine disruptive capabilities, and gemfibrozil is a fibrate drug used to lower lipid levels. Stock analyte solutions were prepared at ppm levels in methanol, followed by dilution in deionized (DI) water (Model MQ Synthesis A10, Millipore Corp., Billerica, Mass., USA) or in other indicated matrices to low ppb levels for the presented work.

For the chlorination experiment, a 20,000 ppm (as $Cl_2$) working stock of sodium hypochlorite (Sigma Aldrich) was prepared in DI water, and a 0.5 M phosphate buffer (pH 7.0) was used for pH adjustment. Artificial urine, water from a closed system decorative Koi fish pond, lager beer with 5% alcohol by volume and primary sewage treatment effluent from a small municipal treatment plant were used without dilution or filtration for complex sample matrices in this study. The samples were contained in either 40 mL clear glass sample vials (Scientific Specialties Inc., Hanover, Md., USA), 4 mL HDPE autosampler cups (Pulse Instrumentation Inc., Milwaukee, Wis., USA), 1.8 mL clear glass chromatography vials (Agilent Technologies, Mississauga, ON, Canada) or custom made 0.5 mL vials fashioned by cutting standard NMR tubes (Norell, Landisville, N.J., USA) to shorter lengths, as indicated. All were washed three times with HPLC grade methanol and dried in air before use. Samples were either unstirred, stirred with a miniature Teflon® stir bar and magnetic stirrer (LAB DISC S56, Fisher Scientific, Vancouver, BC, Canada) or mixed by helium bubbled through the sample via a short length of 22 gauge stainless steel hypodermic tube. All measurements were made at ambient temperature (25° C.) and pressure (101 kPa). For the automation experiments, a commercial autosampler from a flow injection analysis system (Model 301, Alchem Corp., Clackamas, Oreg., USA) was used, modified by mounting the miniature CP-MIMS probe assembly in the sampling turret.

Figure 8:
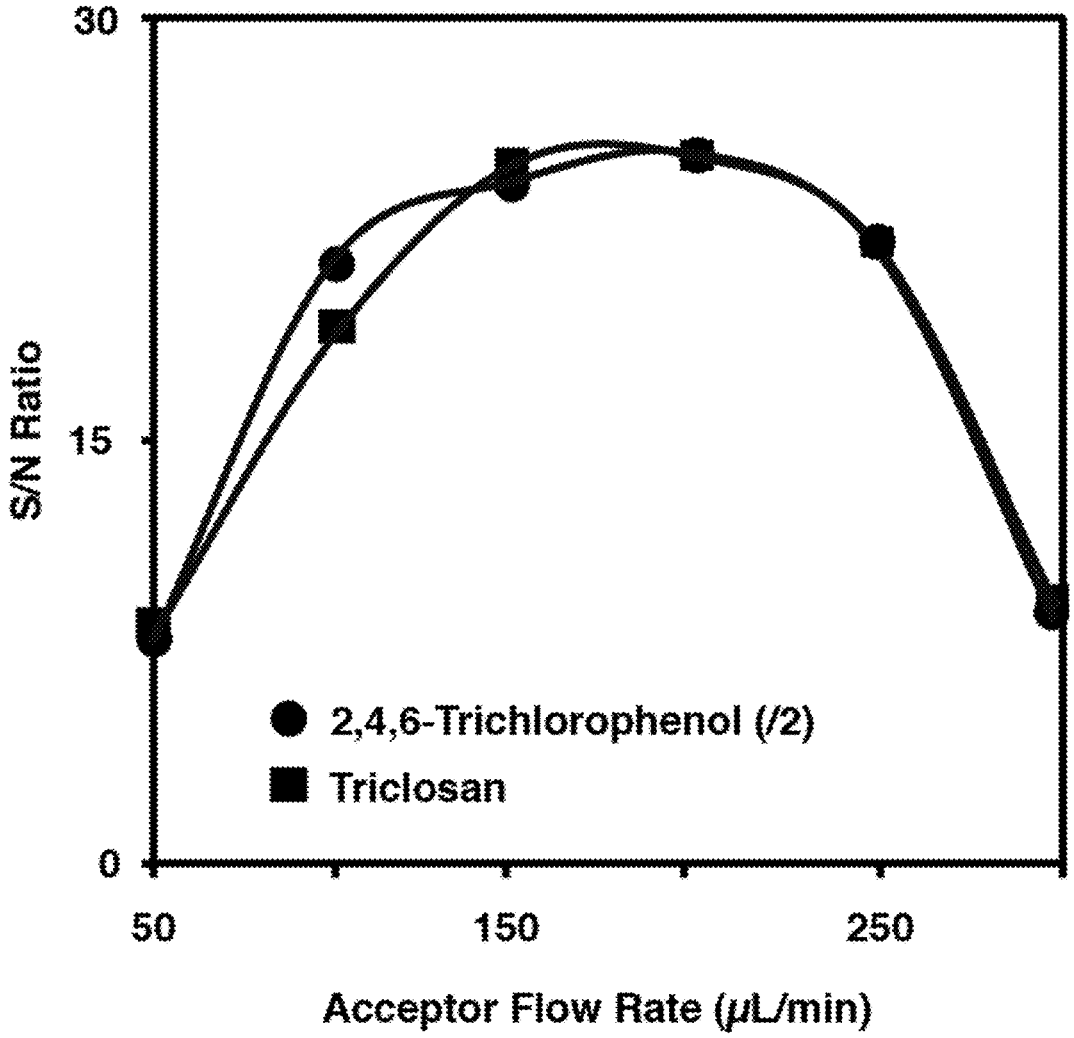
FIG. 8 shows the plot of signal-to-noise (S/N) ratio versus CP-MIMS acceptor flow rate for signals obtained from aqueous solutions of 28 ppb 2,4,6-trichlorophenol and 78 ppb triclosan using a PDMS hollow fibre probe interface in a miniature CP-MIMS coaxial probe system of the present technology. For scaling purposes, the S/N ratios for 2,4,6-trichlorophenol were divided by 2.

The optimum acceptor phase flow was determined by measuring the signal-to-noise (S/N) ratio obtained for the steady-state signals of ppb-level aqueous solutions of 2,4,6-trichlorophenol and triclosan at methanol acceptor phase flow rates ranging from 50 to 300 μL/min. These measurements were made in 40 mL aqueous samples, using a magnetic stirrer and Teflon® stir bar for mixing. After each measurement, the miniature probe was washed clean by immersing it in 40 mL of stirred DI water until the signal returned to baseline levels. The results are given in FIG. 8, and show that the S/N ratio improved from ~50 to 150 μL/min, leveled off between ~150 and 250 μL/min and then decreased at flow rates >250 μL/min. A methanol acceptor phase flow rate of ~200 μL/min provided the best S/N ratio for the miniature CP-MIMS probe and therefore was employed for all subsequent work.

To wash this probe after a measurement or on-line monitoring experiment, it can simply be immersed in DI water until the signals for target analytes return to baseline levels. As noted above, the miniature CP-MIMS probe (unlike flow cell type interfaces) can be cleaned between measurements by simply dipping it in a small quantity of any suitable wash solvent, such as DI water, or any other (membrane-compatible) solvent, like methanol.

Changing the wash solvent provides faster membrane cleaning times between samples (than possible with water), decreasing the wait time needed between samples. Although our previously discussed flow cell interface could also be cleaned with organic solvent, it required much greater quantities of solvent, increasing both the cost and waste produced by each measurement.

Figure 9:
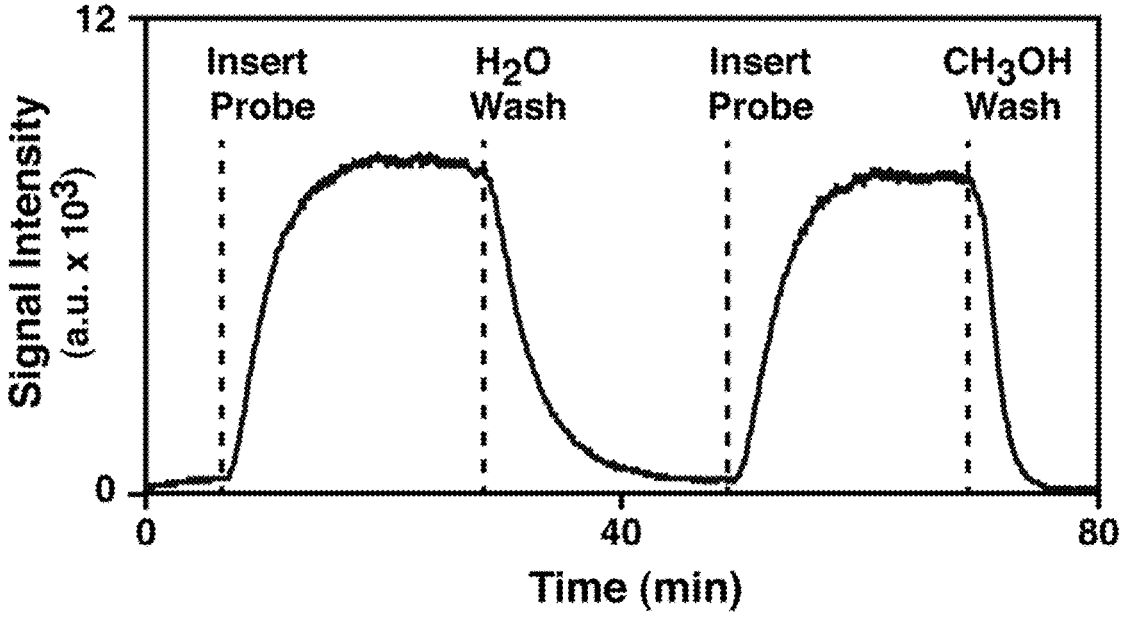
FIG. 9 shows a comparison of the signals for 78 ppb aqueous solutions of triclosan, including wash-out times, using deionized water wash out (left) and methanol wash out (right) with the miniature CP-MIMS probe of the present technology. Return to baseline signal levels for triclosan is achieved approximately three times faster in methanol than in water.

An experiment was conducted to compare the analyte wash-out time after monitoring a 78 ppb aqueous triclosan solution. A 40 mL aliquot of stirred DI water was spiked with triclosan and monitored via direct insertion of the mini CP-MIMS probe. After the signal reached steady state, the probe was transferred to 40 mL of a stirred wash solvent (DI water or methanol). Depletion of the residual triclosan analyte was monitored as it was washed out of the PDMS membrane. FIG. 9 illustrates the advantage of using methanol rather than water as the wash solvent. Methanol removes the triclosan from the PDMS membrane nearly 3 times faster, allowing a shorter duty cycle than would be possible when using a DI water wash. Observed membrane wash-out Improvement Factors (IFs) ranged from 1.2 for less hydrophobic 2,4,6-trichlorophenol (log $K_{ow}$=3.54) to 4.1 for the more hydrophobic nonylphenol (log $K_{ow}$=6.04). Since the neutral form of the analyte partitions out of the aqueous sample and diffuses through the PDMS membrane, the greatest wash-out improvements were for the more hydrophobic analytes. There was a linear relationship between the analyte wash-out IF for methanol/water and the log $K_{ow}$ values for the four compounds studied (IF=log $K_{ow}$+2.4, $R^2$=0.95).

A comparison study was conducted in which aqueous solutions (40 mL) containing 2,4,6-trichlorophenol (28 ppb), triclosan (77 ppb), gemfibrozil (78 ppb) and nonylphenol (53 ppb) were prepared by spiking with the appropriate quantity of stock solutions, followed by measurement with the miniature coaxial probe CP-MIMS system. One solution was not mixed, one mixed with the stir bar/stirrer, and the remaining solution was mixed by bubbling helium through the sample during the measurement. Although helium bubbling provides an approach to mixing samples in small volumes that may not be amenable to stir bar mixing, the potential for loss of volatile analytes exists. However, it should be noted that CP-MIMS in general is well suited for the analysis of low volatility analytes.

The data collected were analyzed for the signal response times ($t_{10\text{-}90\%}$) and 3×S/N ratio detection limits. The unmixed solution yielded the longest response times and poorest detection limits, whereas the helium bubbler and stir bar mixing gave similar results. Without being bound to theory, the increased analyte diffusion path length created by a depleted boundary layer developed at the membrane surface in unmixed samples adds mass transport resistance, reducing the permeability and increasing the transport time as predicted by Fick's law. As would be known to one skilled in the art, other means of mixing are contemplated, for example, but not limited to mechanical vibration.

The results of this study yielded $t_{10\text{-}90\%}$ response times of 2-10 min for the target analytes tested, and detection limits from pptr to low ppb levels.

The depletion of analyte concentrations in small sample volumes was also studied to test if sample pre-screening using the miniature CP-MIMS probe could be followed by a second measurement (e.g., HPLC/MS), using the same sample for both. Using previously published acceptor phase calibration methodologies, when 40 mL of 70 ppb aqueous gemfibrozil was interrogated with the miniature CP-MIMS probe, a gemfibrozil concentration of 9 ppb was observed in the methanol acceptor phase. At an acceptor phase flow rate of 200 μL/min, this corresponds to a total gemfibrozil mass transfer of ca. 2 ng/min from the sample under steady state conditions.

Figure 10:
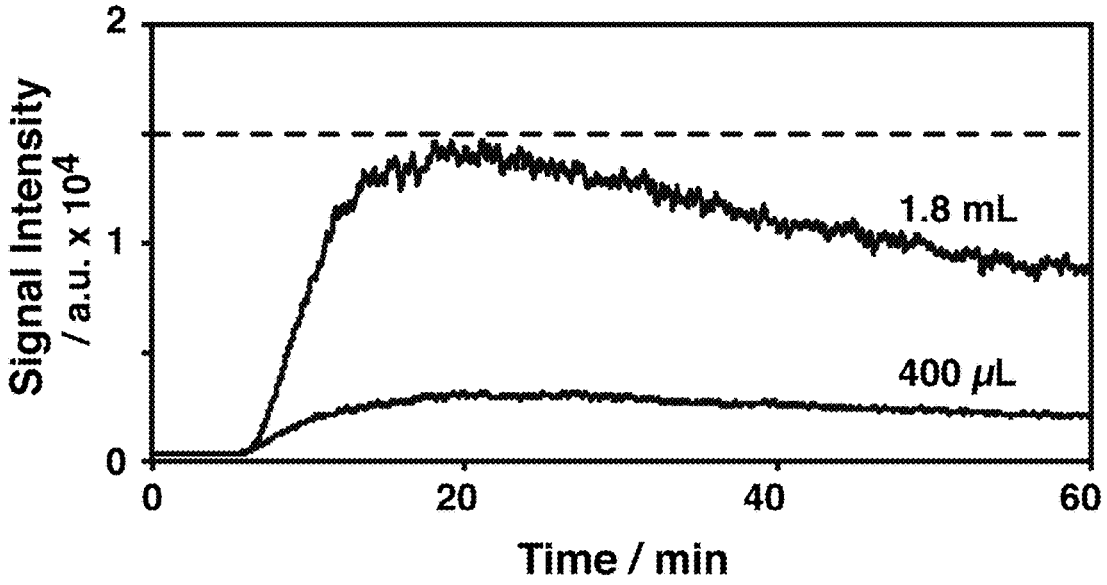
FIG. 10 shows the results of the continuous interrogation of smaller sample volumes of 70 ppb aqueous gemfibrozil with the miniature CP-MIMS probe of the present technology. The dashed line represents the steady-state signal level achieved for 70 ppb gemfibrozil in bulk samples (e.g., 40 mL). It is evident that as sample size is reduced, the effects of signal depletion become more pronounced.

To examine potential analyte depletion effects in small samples, 70 ppb aqueous gemfibrozil samples (1.8 mL and 400 μL) were continuously monitored with the miniature CP-MIMS probe for a 1-h period. The results of this study are shown in FIG. 10. The dashed line represents the averaged steady-state signal level achieved for six replicate measurements of 70 ppb gemfibrozil in bulk samples (e.g., 40 mL). It is evident from the figure that as the sample size is reduced, the effects of signal depletion become more pronounced. The 1.8 mL sample (containing 130 ng of analyte) showed essentially the same maximum signal level as that obtained for larger sample volume measurements. The observed analytical signal begins to decline upon extended measurement times. Without being bound to theory, this is because the analyte permeation had reached a steady state before the depletion analyte became significant. However, in the case of the 400 μL sample (containing 28 ng of analyte), it is evident that the rate of analyte depletion is occurring on a time scale that competes with the rate of analyte permeation through the membrane. Consequently, the signal does not reach the same maximum level (~5× lower than those obtained in 1.8 mL or larger samples). It was noted that the overall mass flux of analyte across the membrane is reduced for the 400-mL sample, resulting in the observed lower sensitivity. Without being bound to theory, in this case, analyte depletion lowers the concentration which governs mass transport according to Fick's laws. In the case of the 1.8 mL sample signals depicted in FIG. 10, there is a greater loss of relative signal over extended time periods because of the higher mass flux. This shows that although extended interrogation of small sample volumes can indeed deplete analyte from the sample, subsequent measurements can still possibly be made in small volumes by secondary measurement strategies, as long as the probe immersion time is kept to a minimum. By further reducing the size of the exposed membrane surface area, or by using non steady state signals for quantitation (e.g., less sample exposure time, vide infra), the amount of analyte extracted from the sample can be further reduced, mitigating analyte depletion effects.

Figure 11:
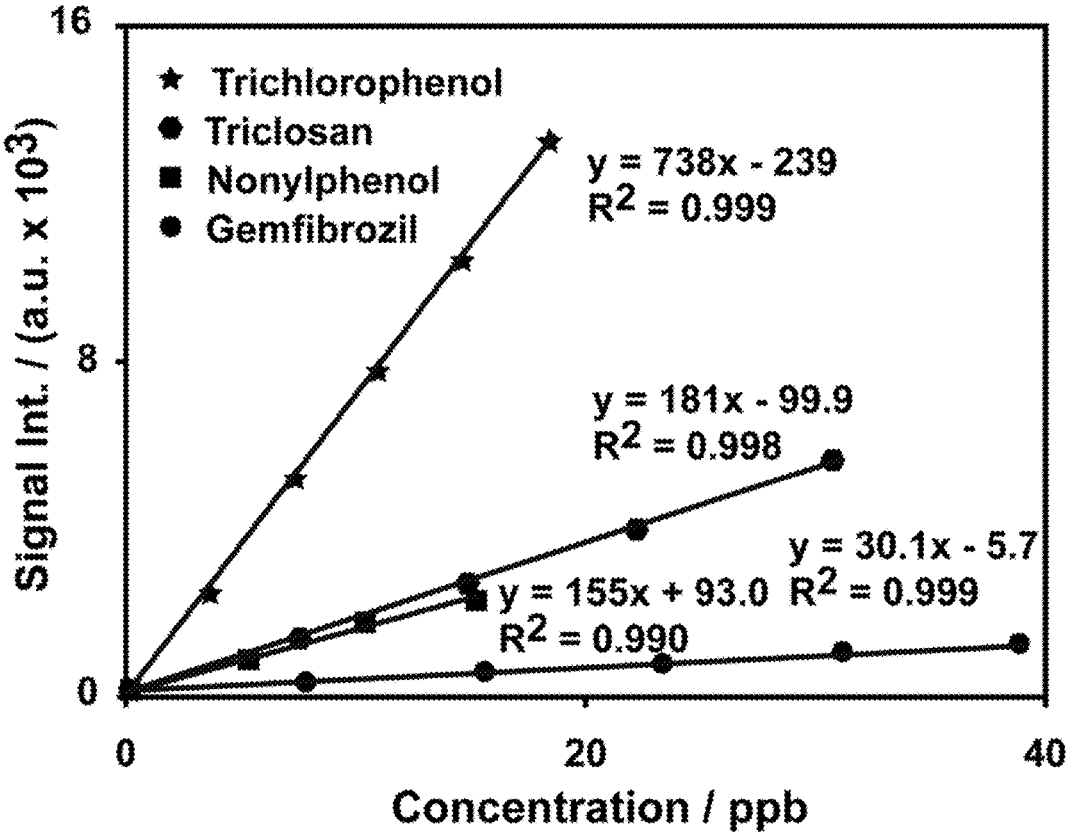
FIG. 11 shows representative calibration curves for 2,4,6-trichlorophenol (3-20 ppb), triclosan (7-40 ppb), nonylphenol (5-15 ppb), and gemfibrozil (7-40 ppb) in DI water using the miniature PDMS hollow fibre probe CP-MIMS interface of the present technology. Each point represents an average of at least 100 steady-state signal data points.

To illustrate the use of the miniature CP-MIMS probe for quantitative measurements, a series of combined aqueous standards in the ppb range was interrogated with the mini CP-MIMS probe, using a magnetic stir bar for sample mixing. The background subtracted steady-state signals for each of the target analytes were subsequently used to generate calibration curves (FIG. 11). As can be seen from the plots, good linearity is observed over the low-ppb concentration range examined. The calibration slopes range from 30 $ppb^{-1}$ for gemfibrozil to 738 $ppb^{-1}$ for trichlorophenol, demonstrating that the system is ca. 25 times more sensitive to trichlorophenol than to gemfibrozil on a per mass basis. Triclosan and nonylphenol exhibit intermediate response with sensitivities that are 6.0 and 5.2 times greater than that of gemfibrozil. Without being bound to theory, these variations in sensitivity can be attributed to differences in both the permeation of the molecules through the membrane and their relative ionization efficiencies in the electrospray source.

The use of a miniature CP-MIMS probe allows the same potential applications for on-line monitoring as its flow cell MIMS counterparts, including its use in flowing streams, but it also can be employed in confined spaces and in smaller volumes of sample than would be practical with flow cell type interfaces. As an illustrative (and comparative) example, the chlorination reaction of aqueous phenol was monitored with the probe system in a 40-mL vial. A sample of DI water, buffered at pH 7, was stirred and spiked to a final concentration of 250 ppb phenol. After the phenol signal reached steady state, an aliquot of sodium hypochlorite was added to achieve an active chlorine concentration of 10 ppm (as $Cl_2$), and the reaction allowed to proceed at 25 C in an uncapped vial.

Figure 12:
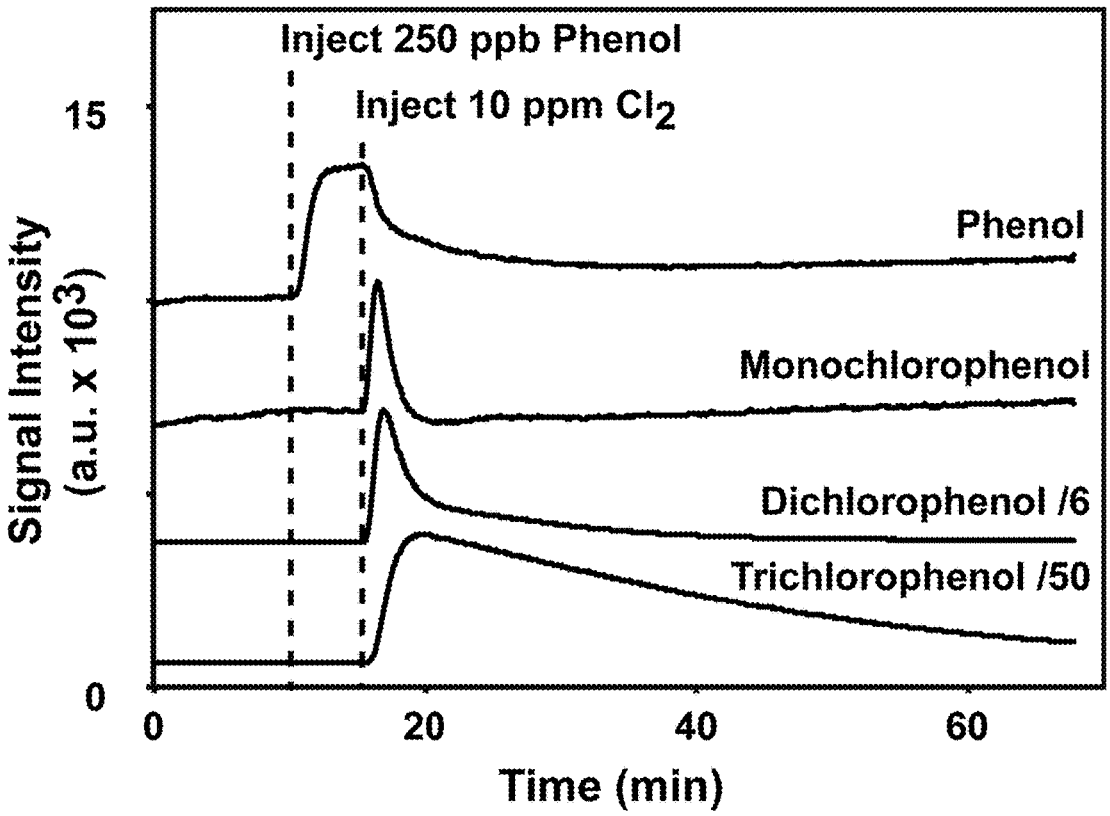
FIG. 12 shows on-line monitoring of the chlorination of aqueous phenol at 25 C in an uncapped 40-mL glass vial using the miniature CP-MIMS probe of the present technology. Mixing of the reaction was accomplished using a miniature magnetic stir bar. The signal traces for each analyte are offset for clarity, and the traces for the di- and trichlorophenols have been re-scaled by dividing them by the indicated factors.

The resulting signals for reactants and chlorinated phenols are illustrated in FIG. 12 as a function of time. No attempt was made to differentiate the structural isomers for mono and dichlorophenols (i.e., both 2- and 4-chlorophenol are monitored by selected ion monitoring (SIM) at m/z 127) nor was any attempt made to monitor subsequent chlorination intermediates/products. The signal for phenol is observed to decrease upon the addition of active chlorine simultaneously with an increase in the signal for monochlorophenol. The subsequent progression of intermediates through di- and trichlorophenol intermediates is similar to that observed when using a flow cell interface plumbed in a closed re-circulation loop with a 500-mL reaction flask.

The results suggest that the miniature CP-MIMS probe could be used for the monitoring of a wide range of chemical systems, environmental testing scenarios and industrial processes. The miniature CP-MIMS probe can readily be implemented in small volume samples or be directly inserted into a continuously flowing sample stream (e.g., a pipeline in an industrial scenario) and offers a simple alternative for in situ reaction monitoring. The miniature probe can be used in sample volumes that are as little as about 100 μL or about 200 μL or about 400 μL. In comparison, the minimum flow cell sample volume is in the range of about 5 mL to about 10 mL, although it would be impractical to flow the sample with such a small volume. The flow cell is more robust than the miniature probe and is well suited to online continuous monitoring where sample volume is not a consideration. It is also more suited to automated flow dilution(s) and for process monitoring.

EXAMPLE 11

To demonstrate automated use, a rotary tray autosampler system from a flow injection analyzer was adapted to use the miniature CP-MIMS probe. The PEEK™ transfer lines employed were flexible enough that the movement of the probe in the autosampler system was unhindered.

Figure 13:
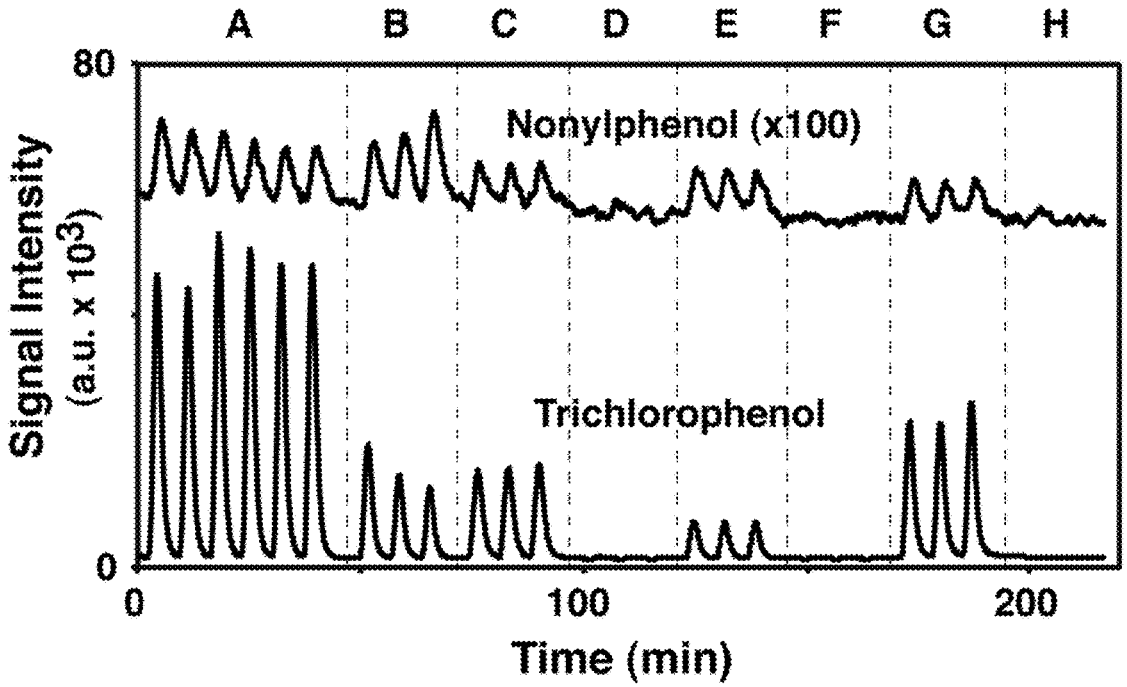
FIG. 13 shows typical data for the miniature CP-MIMS probe of the present technology when implemented in an automated analysis series of a variety of sample matrices spiked with ppb levels of target analytes. The top trace (offset for clarity) is the signal for nonylphenol (100 ppb, signal/100 for scaling purposes) and the bottom trace is for trichlorophenol (50 ppb). In each peak, a 4-mL unstirred sample was analyzed for 99 s with the probe. All samples were analyzed 'as is' without dilution or pre-filtration. The sample matrices evaluated included DI water (A), Koi pond water (B), beer (C spiked, D unspiked), artificial urine (E spiked, F unspiked) and primary sewage wastewater effluent (G spiked, H unspiked). All samples were analyzed in triplicate, except the DI water (6 replicates).

For this study, the autosampler was equipped with 4-mL sample cups and used a maximum programmable sampling time of 99 s/sample. Trichlorophenol (50 ppb) and nonylphenol (100 ppb) were analyzed in a wide variety of sample matrices. Sample matrices, including DI water, Koi pond water, beer, artificial urine and primary sewage waste water effluent, were studied. The samples were well mixed before the autosampler cups were filled, and measured as part of a continuous sample sequence by a 99-s miniature CP-MIMS probe immersion in each sample. The probe was rinsed by automated immersion in clean methanol for 99 s between replicate samples and for 197 s between sample types. All samples were directly analyzed without dilution, pretreatment or filtration. FIG. 13 gives the observed signal traces for the detection of the target analytes.

In evaluating the use of this simple autosampler system, it should be noted that samples were not mixed during the probe immersion. Although the exposure time of the membrane probe to the sample was very reproducible (because of the automation), it was not long enough to allow for steady-state signal development. Analysis of the data showed similar relative standard deviations for both peak height and peak area measurements at ~10% for three replicates within the same sample matrix. Fitting the autosampler with a mechanism to agitate the probe or to mix the samples would improve this precision. The signals observed for trichlorophenol (50 ppb) were much stronger than those for nonylphenol (100 ppb), but were slightly less reproducible. This analyte-dependent sensitivity/precision is readily explained by the fact that CP-MIMS is ~5× more sensitive to trichlorophenol than to nonylphenol. Furthermore, the signal response time for nonylphenol to reach steady state is ~4 times longer than that for trichlorophenol. Taken together, these factors contribute to the greater sensitivity observed for trichlorophenol over nonylphenol (FIG. 13).

Although some signal suppression effects for the complex samples were observed, with analyte signal levels ranging from 13 to 120% compared with those obtained for DI water samples, the effect appears to be both analyte- and matrix-dependent (FIG. 13).

The observations in FIG. 13 suggest that miniature probe CP-MIMS, even with signal suppression effects, allows direct measurements for trace level analytes in complex samples that would otherwise require substantial cleanup, preconcentration and/or chromatographic separations prior to analysis, and that would not be detected in direct infusion flow injection experiments.

These experiments demonstrate the potential of miniature probe CP-MIMS as a rapid, automated pre-screening technique to identify 'positive' samples for subsequent quantitation by conventional methods (e.g., HPLC/MS). It is contemplated that this system, when coupled to a modern autosampler system, will provide the possibility of a logic driven automated pre-screen prior to more time-consuming cleanup and chromatographic analyses is foreseeable.

EXAMPLE 12

Figure 14:
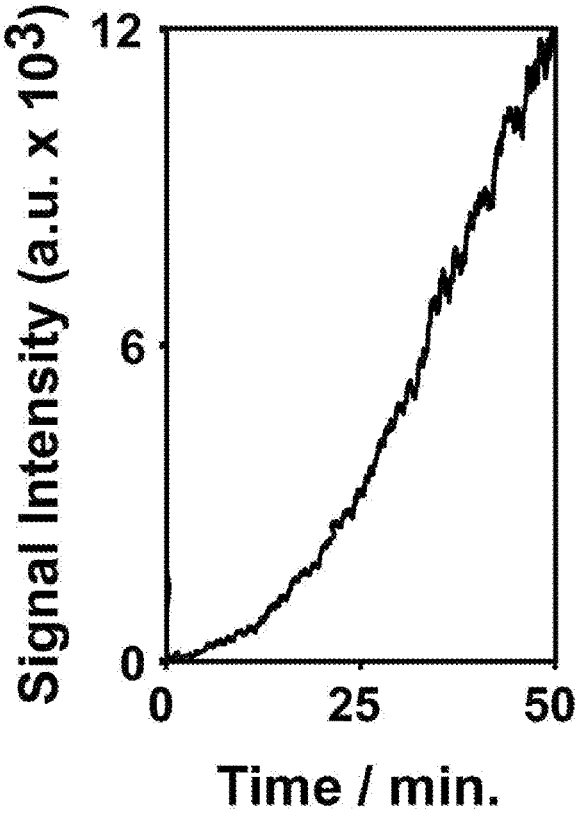
FIG. 14 shows the continuous in situ/in vivo monitoring of gemfibrozil osmotic transport in a plant stem obtained using the miniature CP-MIMS of the present technology and the miniature CP-MIMS of the present technology.
Figure 14:
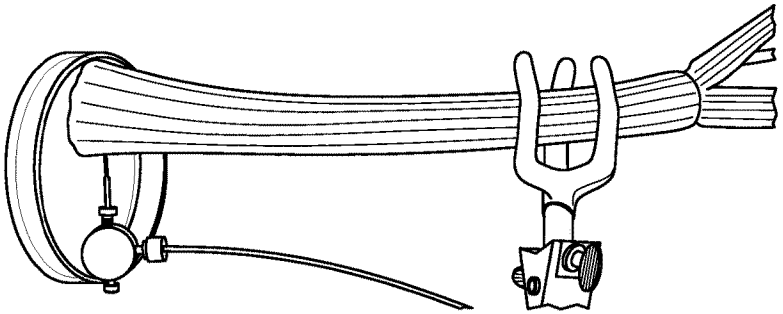

Direct, in vivo/in situ monitoring was demonstrated with the mini probe as described above. A large, freshly cut celery plant stalk (*Apium graveolens*) was carefully pierced 1 cm from its base with a small twist drill bit to allow direct, horizontal insertion of the miniature CP-MIMS probe, such that the active membrane surface was completely inside the stem. The stalk with embedded probe was mounted vertically with 1 mm of its base immersed in 50 mL of 130 ppm aqueous gemfibrozil solution. The system was left undisturbed, and the subsequent osmotic transport of gemfibrozil up the celery stalk recorded using the miniature CP-MIMS probe system for nearly an hour (FIG. 14). Although no attempt was made to quantify the transport rate for the analyte in the live plant stem, this demonstrated the potential for the use of the miniature CP-MIMS probe in continuous monitoring in vivo studies, similar to those currently employing micro-dialysis.

EXAMPLE 15

Figure 15:
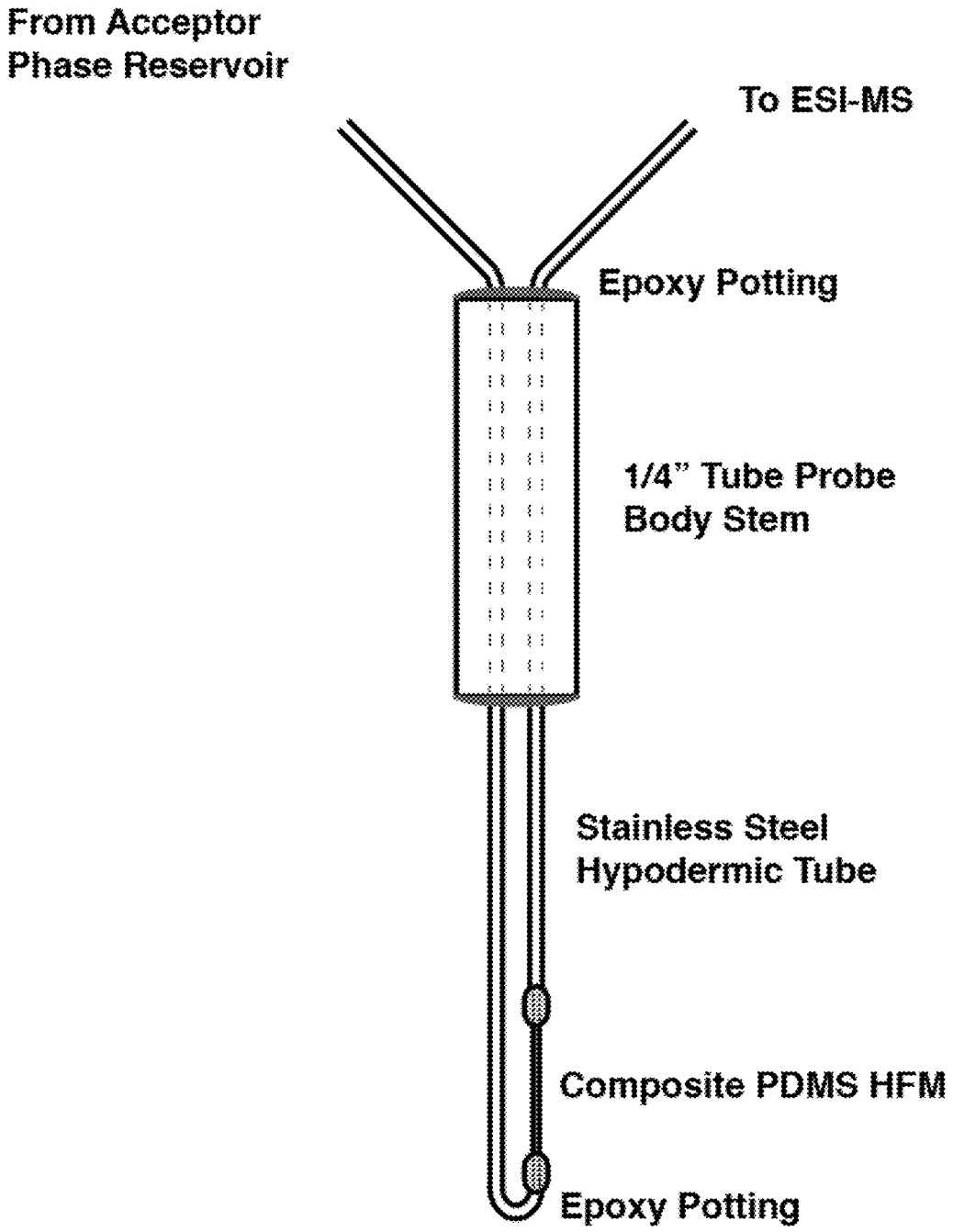
FIG. 15 shows a miniature CP-MIMS J probe of the present technology.
Figure 16A:
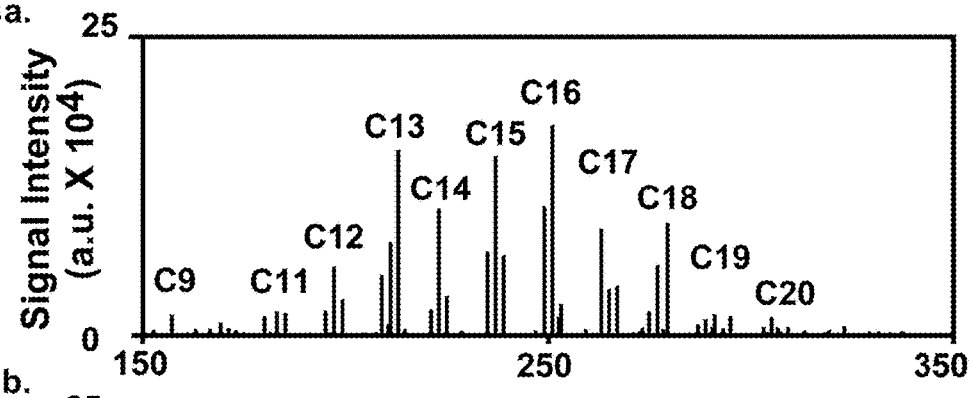
FIG. 16*a* shows a full scan mass spectrum for 1 ppm of a NA mixture (Merichem) in de-ionized water.
Figure 16B:
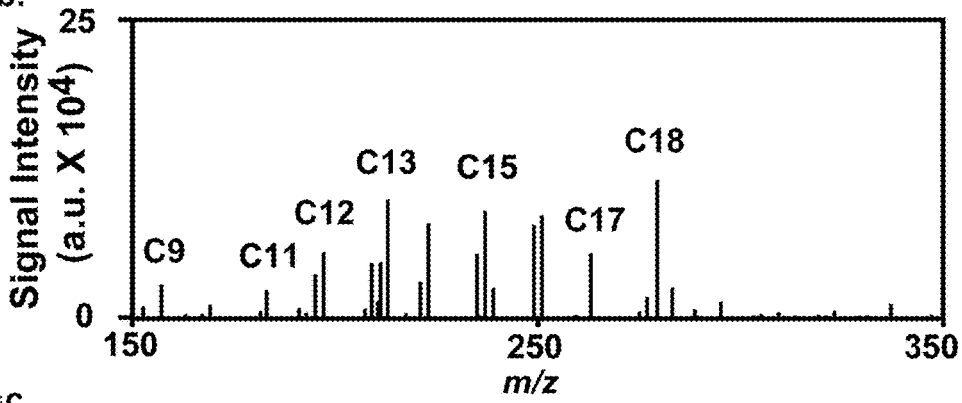
FIG. 16*b* shows a full scan mass spectrum for the same NA mixture after ~45 minutes of photolysis at 254 nm in the presence of 2 mM $H_2O_2$ monitored by CP-MIMS using a 2.0 cm length of composite PDMS HFM mounted in the J-Probe CP-MIMS interface (FIG. 15).
Figure 16C:
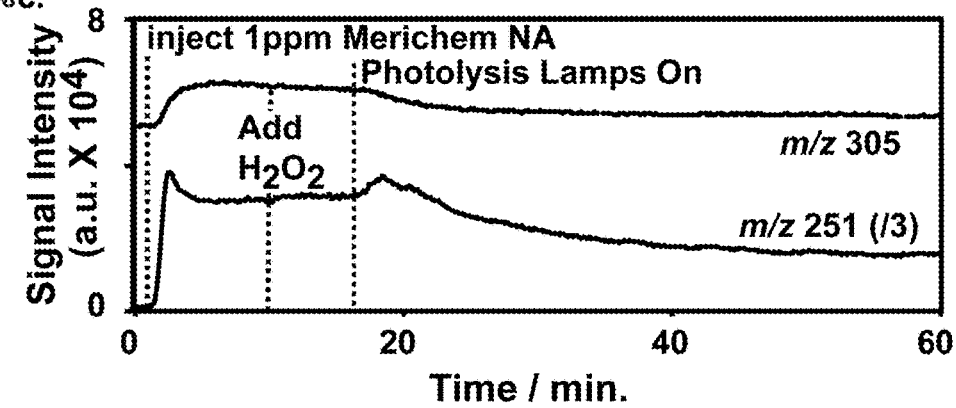
FIG. 16*c* shows SIM signals for several NA m/z values for the online monitoring of this photolysis experiment. The spike in signal for m/z 251 at 2.5 min. is attributed to the NA mixture at injection not being completely mixed, exposing the CP-MIMS insertion probe to a higher initial concentration. This signal spike is not observed at m/z 305 because of its concomitantly longer signal rise time.

To illustrate the potential for rapid screening, on-line monitoring applications of delicate PDMS CP-MIMS interfaces, a photochemical destruction study was conducted in which a 900 ppb Merichem NA sample in DI water was irradiated with 254 nm UV photons in the presence of 0.7 mM $H_2O_2$. The sample was continuously monitored over the course of the experiment by both full scan and selected SIM scans using a 2.0 cm length of composite 0.5 μm PDMS HFM mounted in a 'J-Probe' immersion CP-MIMS interface (FIG. 15). The 'J-Probe' interface was designed to be used for direct monitoring in smaller sample volumes and for direct insertion sample monitoring and screening purposes: for this study, its incorporation was as a direct insertion, on-line monitoring probe. Experimentally, this was accomplished by suspending it in a 100 mL glass recirculation flask, allowing the sample flow through the flask (250 mL/min) to provide sample mixing at the HFM probe surface. FIG. 16 summarizes the results of this demonstration. On inspection of the background subtracted full scan mass spectra obtained before irradiation (FIG. 16.*a*.) and after ~45 minutes of UV/$H_2O_2$ photolysis (FIG. 16.*b*.), it is evident that the majority m/z for NA species have reduced signal intensities, suggesting at least partial destruction of the NA species present. FIG. 16.*c*. gives representative SIM plots for two of the selected NA m/z values monitored. As is evident, the lower m/z value signal has a faster rise time ($t_{10-90}$~1 min), observed when the Merichem NA is spiked into the system. When the UV lamps are turned on, there is a minor production of signal at m/z 251, followed by a subsequent decay. This is not evident for m/z 305, but may be partially because of the longer signal rise time ($t_{10-90}$~2 min) for these larger NA species. This shows that the system can be used to make direct, rapid on-line, high sensitivity NA measurements and profile determinations. This allows for the potential use of CP-MIMS for direct NA source fingerprinting, and could be used to indicate sample aging, weathering or other processes without the need for sample handling and cleanup that would be required for trace level samples using direct infusion strategies.

EXAMPLE 16

By adjusting the upstream sample pH, a sequence of CP-MIMS measurements can be carried out on a NA sample to provide additional compositional information. The pH is adjusted such that NAs are ionized (any pH>6) and the analyte is measured and quantified. The sample is then acidified (any pH<4) with a strong acid, and the sample is re-analyzed. The first experiment measures 'neutral compounds' (those that are un-ionized at pH>6). The second experiment measures those which are un-ionized at pH 4 (this includes neutrals+NAs). The difference between the two, will be those compounds that were ionized at pH>6 and un-ionized at pH 4 (i.e., carboxylic acids such as NAs). Similarly, by adjusting the concentration of other cations (e.g., $Ca^{2+}$, $Pb^{2+}$, $Cd^{2+}$) at a constant pH, one can use the resulting CP-MIMS signals for the determination of the corresponding metal—ligand formation constants. This information can be useful when one is dealing with complex mixtures and multiple formation constants can be determined for isomer classes in cases where the pure components are not available or known.

EXAMPLE 17

Individual molecules within the class of NAs have different sizes and the response time with CP-MIMS is size dependent (as described above). Therefore, CP-MIMS can be used to provide information about molecular sizes (sometimes referred to as hydrodynamic volume). This information can be useful when one is dealing with complex mixtures and the exact chemical structure of individual compounds is not known and/or the pure components of the mixture are not available for individual study. Molecular size determination can be a important predictor of other transport phenomena and can be used to inform cellular uptake rates and toxicity studies.

EXAMPLE 18

The method allows for monitoring changes in the compositional distribution of compounds. The distribution of individual components in a complex mixture can provide useful information when monitoring the extent of chemical weathering, the effectiveness of certain processes (both natural and industrial) and can be applied to source identification.

EXAMPLE 19

Figure 18:
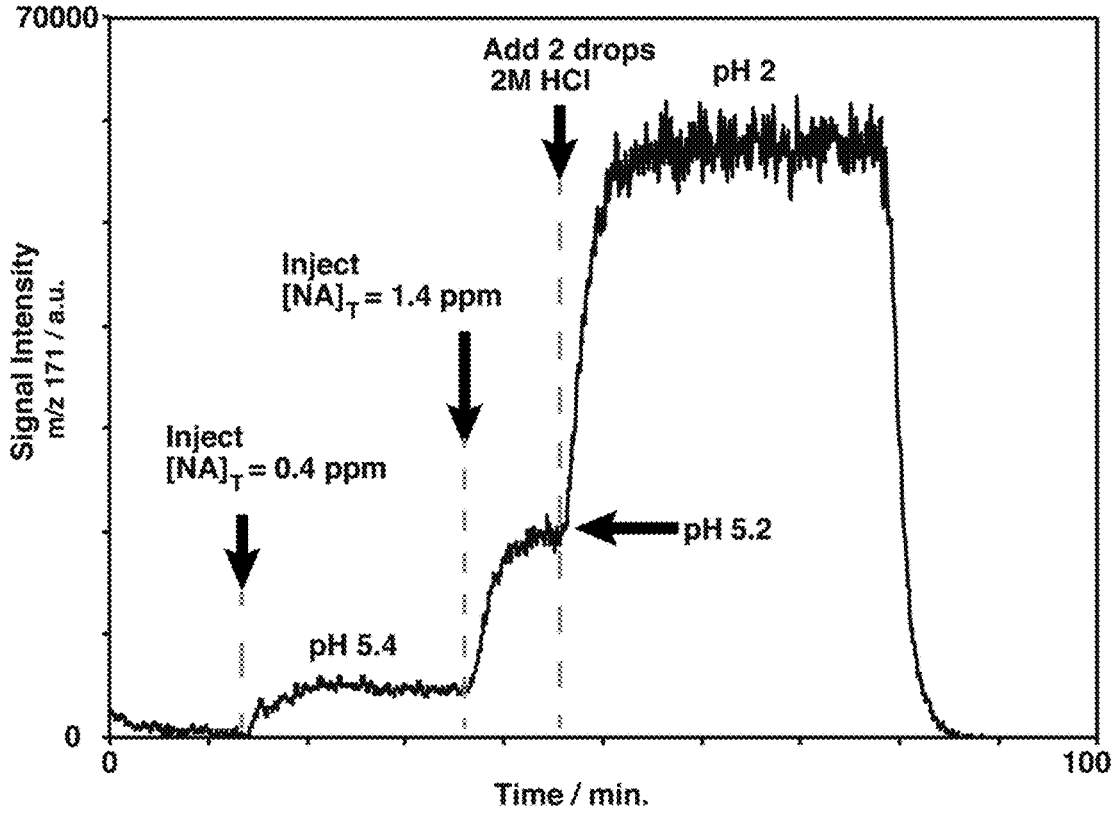
FIG. 18 shows the signal response for NA m/z 171 obtained for a Merichem naphthenic acid mixture spiked at two concentrations in deionized water, and the effect of acidification upon the analytical signal.

A study was conducted in which the effect of pH upon the observed CP-MIMS signals for naphthenic acids (NA). Two spike levels of NA (0.4 and 1.4 ppm total Merichem NA) were added to a 40 mL stirred (magnetic stir bar) deionized water sample, and the CP-MIMS signal responses were recorded, as well as the pH of the solution. For this experiment, the J-Probe type CP-MIMS interface was used with a 2.0 cm length of PDMS HFM that was 170 μm thick. FIG. 18 is an example of typical results observed for NA m/z 171. After the signals for the 1.4 ppm total NA reached a steady state at pH 5.2, HCl was added to the sample to yield pH 2. Without being bound to theory, acidification of the sample results in protonation of the naphthenic carboxylate ions to their neutral (acidic) forms, which are considerably more hydrophobic and thus readily partition into the PDMS membrane. This dramatically increases the observed signal intensity. Because the PDMS is selective for neutral analytes, a simple pH adjustment yields superior analytical results (FIG. 18). This can be taken further, by measuring the observed signals before and after acidification. By measuring the signals in a weakly buffered sample at pH 8, it is anticipated that only neutral species present in the sample (not NA) would be able to pass through the PDMS. A subsequent measurement at lower pH (e.g. 2) would be the sum of the neutral species and NA. Subsequent subtraction of the data obtained at pH 8 from those obtained at pH 2 would yield a representation of the species capable of accepting acid protons (e.g. just NA). As well, the measurement of signals obtained at several known, intermediate pH values will allow the determination of the fractional abundance of protonated/not protonated species, providing a route for the calculation of pKa values for various NA isomer classes (m/z values). Using the data presented in FIG. 18, the fractional abundance of the $C_{10}H_{20}O_2$ at pH=5.2 is determined to be 0.33. This can be shown to correspond to an effective pKa=4.9 for this isomer class. Furthermore, it is anticipated that further improvements in the transport and ionization of NAs can be obtained by adjusting the pH of the methanol acceptor phase. Adding a small amount base to the acceptor phase will establish a pH gradient across the membrane, increasing the driving force for NA transport and may also improve the ionization by negative ion ESI.

EXAMPLE 20

Figure 19A:
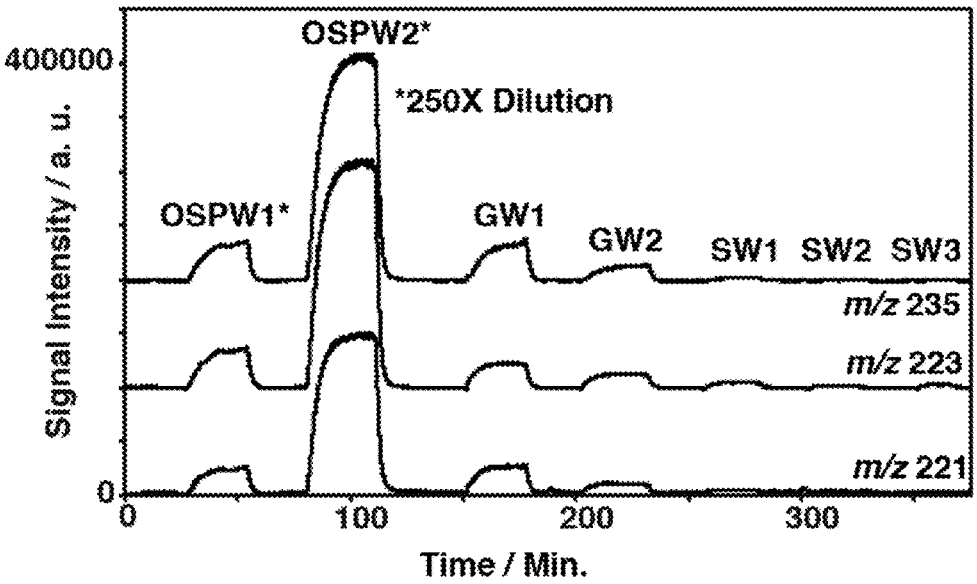
FIGS. 19*a* and 19*b* show the direct detection and measurement of NA in a wide variety of environmental samples.
Figure 19B:
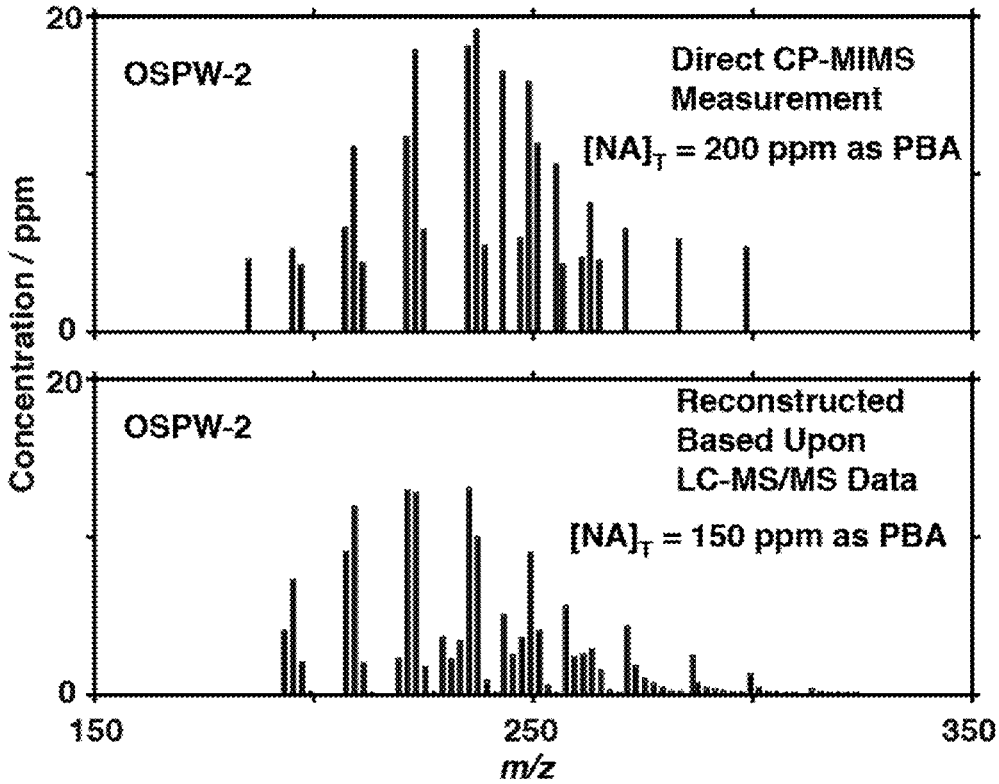

To demonstrate the capabilities of CP-MIMS for the detection and measurement of NAs in a wide range of typical environmental samples, 40 mL EPA type water sample vials were filled with a variety of different water samples obtained from northern Alberta, including oil sands process water (OSPW-1,2), ground water (GW-1,2) and natural surface waters (SW-1,2,3). The samples were acidified to pH 4.0 with 2M HCl, then stirred (magnetic stir bar) and sequentially measured with the CP-MIMS system using the 'J-Probe' type interface equipped with a 2.0 cm length of PDMS HFM that was 170 μm thick. The sample probe was removed from each sample when steady signals were obtained, and the probe washed with methanol between each sample until baseline signals were achieved. FIG. 19*a* shows SIM signal intensities (chromatograms) at m/z 221, 223 and 235 for the measurement sequence of the seven samples. Naphthenic acid concentrations in these samples have been verified by a solid phase extraction, chemical derivitization, and liquid chromatography tandem mass spectrometry (LC-MS/MS) and range from very high (>10 ppm) for OSPWs to very low (<10 ppb) for the SW samples. The signal intensities on the chromatograms obtained by CP-MIMS (FIG. 19*a*) shows good agreement with the total NA concentrations obtained by a verified off-line technique. FIG. 19*b*. compares the distribution of naphthenic acid isomer classes of OSPW-2 for CP-MIMS and the liquid chromatography tandem mass spectrometry method. Signal intensities of each isomer class have been converted to an equivalent concentration of pyrene butyric acid (PBA) giving rise to the same signal. The bottom panel illustrates the reconstructed NA concentration data from M.B. Woudneh et al. (Journal of Chromatography A, 2013, 1293, 36) also in terms of PBA. The CP-MIMS total NA concentration obtained directly from sample in roughly 10 minutes agrees remarkably well with that obtained by LC-MS/MS, which is both time and labour intensive and requires consumable reagents and solvents. Results from CP-MIMS are observed to over-predict total NA concentrations, which is acceptable for a rapid screening method. We can further refine CP-MIMS screening by running samples at pH 7 followed by an acidification step and analysis at pH<4. At pH 7, naphthenic acids will be present in aqueous solution in their ionized forms and will not permeate the membrane. After the acidification step, the NAs can be detected. By subtracting the spectral intensities obtained at pH 7 from those at pH<4, one can remove the non-naphthenic acid components.

EXAMPLE 21

Figure 20:
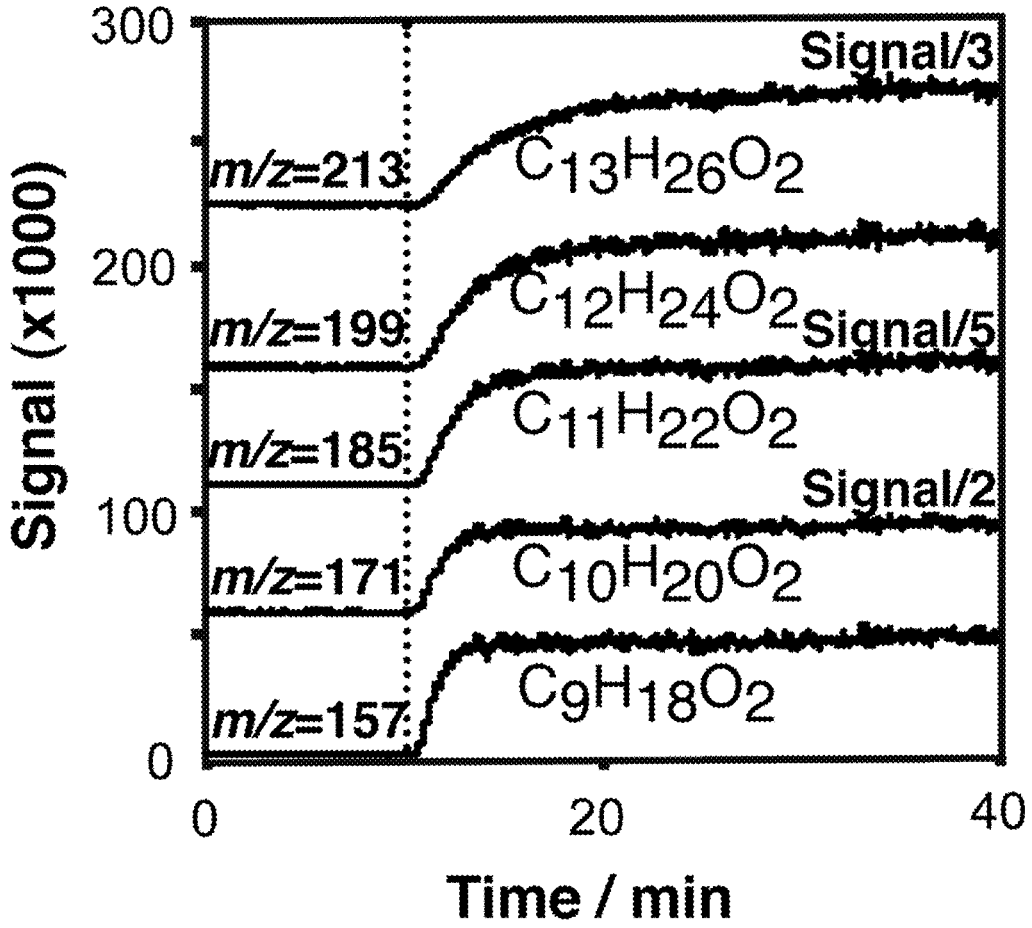
FIG. 20 shows the signal response for the NA m/z signals obtained for various isomer classes to a step function increase in aqueous NA acids. Data obtained from a 10 cm long PDMS HFM with 215 μm thickness.

To demonstrate the capabilities of CP-MIMS for the determination of intrinsic molecular properties such as diffusion coefficients and hydrodynamic volumes, the response times of various isomer classes to a step-function increase in upstream NA concentration was determined. The chromatograms displayed in FIG. 20 illustrate that smaller NA components exhibit faster response times. By establishing a trend line with a set of training compounds of known hydrodynamic volumes, it is anticipated that CP-MIMS can be used to determine volumes of many components in a complex mixture. These data are useful in predicting isomer structures, diffusion coefficients, environmental distribution, cellular uptake and toxicity.

EXAMPLE 22

Dilute aqueous solutions of Merichem naphthenic acids (50-1000 ppb) were analyzed using an immersion 'J-probe' membrane interface coupled to CP-MIMS with a methanol acceptor phase. Because naphthenic acids are a complex mixture of structurally related isomer classes, typically ranging in molecular weight from ~150-400 atomic mass units (amu), membrane performance (response time and sensitivity) was characterized at five different mass/charge ratios spanning 213-305 amu.

Response times were measured as the time required for the signal intensity to rise from 10 to 90% of its full steady state value as a result of switching from a clean water sample to one that contains a Merichem naphthenic acid mixture. In general, response times are independent of chemical concentration. As can be seen in Table 4, the thin PDMS composite membrane demonstrates a 10 to 20-fold reduction in response time over the thicker 35 μm PDMS membrane. These faster response times are advantages when making rapid measurements and significantly reduce the duty cycle. The 170 μm PDMS interface, gives rise to similar or slightly longer response times than the 35 μm membrane. It should be noted here that for identical materials, the response times are predicted to increase with the square of the thickness, however PDMS from different sources can and will have different perm-selectivities and viscosities due to differing polymer chain length, cross-linking and additives.

The sensitivity of these membrane interfaces to various isomer classes was assessed by measuring the signal to noise ratios at various m/z values resulting from a 50 ppb sample of Merichem. The detection limit was estimated based on the concentration of Merichem naphthenic acid solution giving rise to a peak at 3 times the signal/noise ratio. In general, the thicker membrane with the larger outside diameter was the most sensitive to naphthenic acids with detection limits ranging from 5 to 10 ppb. The detection limits for the thinner membranes is somewhat higher, ranging from 10 to 40 ppb for the isomer classes monitored here.

EXAMPLE 23

Figure 21:
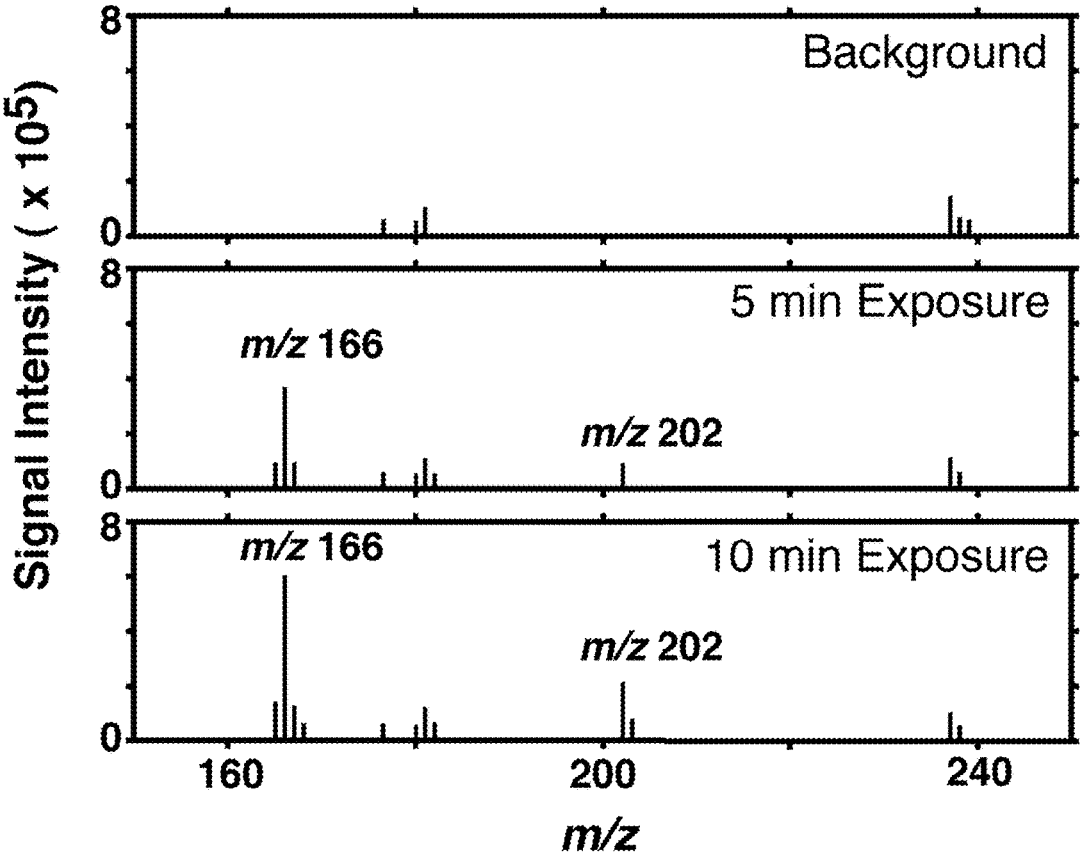
FIG. 21 shows full scan FT-ICR mass spectra demonstrating the direct, on-line analysis of dilute aqueous solutions containing PAHs using a methanol acceptor phase and APPI source. Background shows the background mass spectrum of a water sample before adding PAHs obtained from CP-MIMS immersion probe with methanol acceptor phase. 5 min Exposure shows the mass spectrum 5 min after representative PAHs were added showing molecular ions at m/z=166 and 202 for fluorene and pyrene, respectively. 10 min Exposure shows the mass spectrum after 10 minutes exposure to CP-MIMS interface shows increased signal intensity. Interface is constructed from a 2.0 cm length of a Silastic brand PDMS capillary hollow fibre (wall thickness of 170 μm) in an immersion type J-probe configuration. Methanol acceptor phase (200 μL min-1) was directed into an APPI source (10.6 eV Krypton) before mass spectra were obtained in a FT-ICR MS.
Figure 22A:
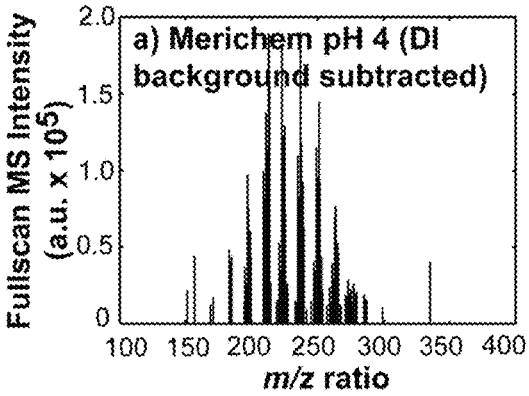
FIGS. 22*a* to 22*f* show aqueous solutions containing 6.2 ppm of Merichem naphthenic acid standard.
Figure 22B:
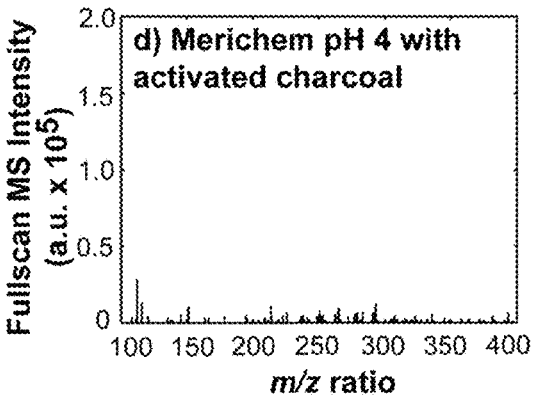
Figure 22C:
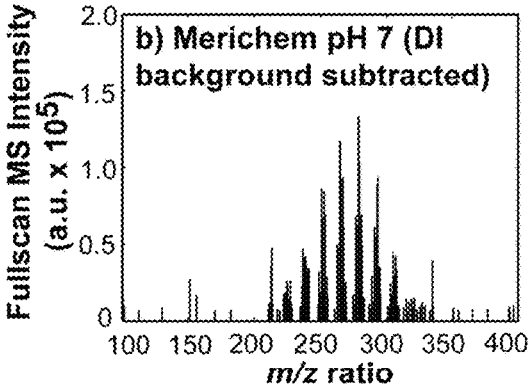
Figure 22D:
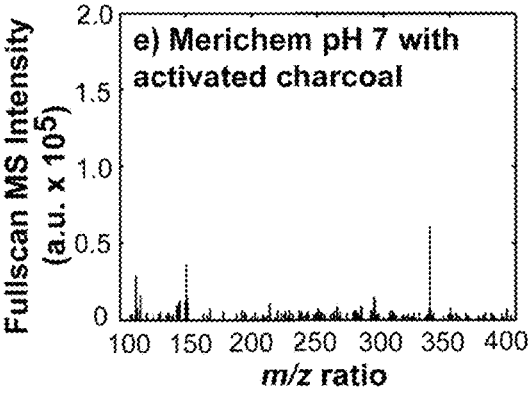
Figure 22E:
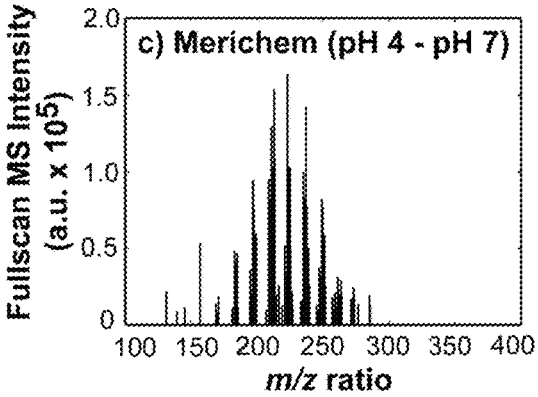
Figure 22F:
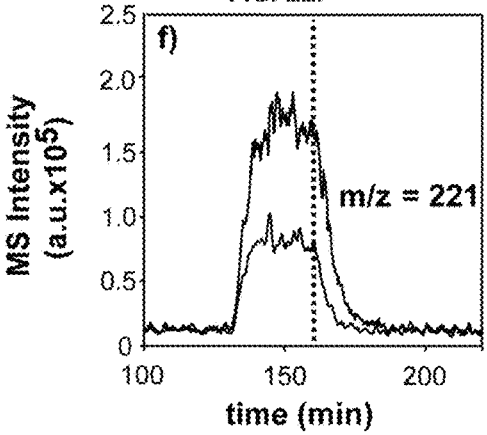

CP-MIMS for direct measurement of polyaromatic hydrocarbons (PAHs) in dilute aqueous solution, as shown in FIG. 21.

Water samples containing representative PAHs were analyzed by CP-MIMS using an immersion J-probe capillary PDMS interface. A methanol acceptor phase was flowed through the membrane capillary at 200 uL $min^{-1}$ and transported to an Atmospheric Pressure Photoionization source whereupon the molecular ions for both fluorene and pyrene ([M+]=m/z 166 and 202, respectively), were observed within 5 minutes by Fourier Transform Ion Cyclotron Resonance Mass Spectrometry (FT-ICR-MS).

EXAMPLE 24

CP-MIMS for monitoring changes to the mass profile of complex naphthenic acid mixtures treated with adsorbent, as shown in FIG. 22.

Water samples containing a complex mixture of naphthenic acids at pH 4 and pH 7 were analyzed by CP-MIMS using a methanol acceptor phase and electrospray ionization (ESI) in negative ion mode and a triple quadrupole mass spectrometer.

Full scan data between m/z=100-400 shows the mass profile of naphthenic acid isomer class families. At pH 4 both naphthenic acids are protonated and readily cross the membrane interface along with other neutral hydrophobic molecules, such as alcohols (FIG. 22, Panel A). At pH 7 only neutral alcohols will be detected (FIG. 22, Panel B). Hence, the difference between the mass spectra obtained at pH 4 and that obtained at pH 7 will represent the naphthenic acids (FIG. 22, Panel C). This data demonstrates the ability to use CP-MIMS to segregate compound classes by adjusting the sample pH and to quantify the total naphthenic acid concentration using the difference spectrum between pH 4 and pH 7.

The addition of activated charcoal as an adsorbent was followed by CP-MIMS in real-time in full scan mode showing a dramatic decrease in the naphthenic acid concentration after about 20 mins of stirring. Mass spectra for the pH 4 and pH 7 solutions after exposure to activated charcoal is shown in FIG. 22, Panels D and E.

Panel F illustrates the ability to follow the kinetics of removal for specific isomer classes (mass/charge windows) in real-time over the course of the treatment process. This data demonstrates the ability to use CP-MIMS follow treatment processes of complex mixtures of naphthenic acids in heterogeneous aqueous solutions.

EXAMPLE 25

Duncan et al. 2015 Journal of Mass Spectrometry, 50: 437-443, the contents of which are incorporated herein in their entirety by reference, discloses implementation of a continuously infused internal standard in the membrane acceptor phase, and modulation of the acceptor phase flow rate to mitigate suppressed analyte signals.

Quantitation of analytes can be improved by varying the acceptor flow rate. At higher acceptor flow rates, for example, but not limited to 500 μl min versus 200 μl min, the sensitivity decreased but ionization suppression was also reduced. This extended the Linear Dynamic Range (LDR) to higher sample concentrations. This was accomplished iteratively. Flow rates can be as low as 100 nL/minute.

EXAMPLE 26

An on-the-fly acceptor phase flow rate adjustment with an automatic calibration feedback system will be used. For example, if an observed analyte signal is too high for the measured LDR, the acceptor flow will be increased, providing an online dilution to effectively extend the method's LDR.

EXAMPLE 27

A second approach for extending the LDR and mitigating ionization suppression employed a continuously infused internal standard by the addition of internal standard to the acceptor phase. By infusing the internal standard into the acceptor phase, the concentration of analyte in the sample was determined with minimal sample modification. This approach maintained sample integrity for future or further analysis and had the added benefit of allowing for direct observation of and correction for any deviations in ionization efficiency. To demonstrate this strategy, 5 ppb of aniline-d5 was added directly to the acceptor phase, and aniline was successively spiked into 1 l of stirred de-ionized (DI) water to generate calibration data. The measured aniline signals were normalized with the internal standard signal and plotted against aniline concentration. Excellent calibration linearity was observed for the entire concentration range examined (spanning six orders of magnitude). High concentrations of aniline in the sample resulted in the aniline-d5 signal being suppressed by as much as ~90%. However, when the sample was replaced with DI water, the aniline-d5 signal quickly returned to its original level. Therefore, adding an appropriate internal standard to the acceptor phase can enable the correction of ionization suppression effects and provide an excellent LDR when using ESI. Either labeled or non-labeled internal standards are viable alternatives when isotopically labeled molecules are not readily available. The internal standard is preferably the same compound as the analyte, but it may alternatively be a similar compound with similar characteristics.

EXAMPLE 28

Duncan et al. 2015 Journal of Mass Spectrometry: A semi-quantitative approach for the rapid screening and mass profiling of naphthenic acids directly in contaminated aqueous samples, in press, the contents of which are incorporated herein in their entirety by reference, discloses approaches to increasing CP-MIMS sensitivity for Naphthenic acids including decreasing the acceptor phase flow rate, heating the membrane interface, increasing the surface area of the membrane interface, and the use of base (for example, but not limited to sodium acetate) within the acceptor phase to enhance ionization. Acceptor phase ionization enhancers include acids, bases, anions and cations, in addition to simple alkanes, simple aromatics, simple alkanes functionalized with amines or carboxylates, and simple aromatics functionalized with amines or carboxylates.

EXAMPLE 29

Positive ion mode with CP-MIMS can use protonated amines or cationized acids.

EXAMPLE 30

Figure 23:
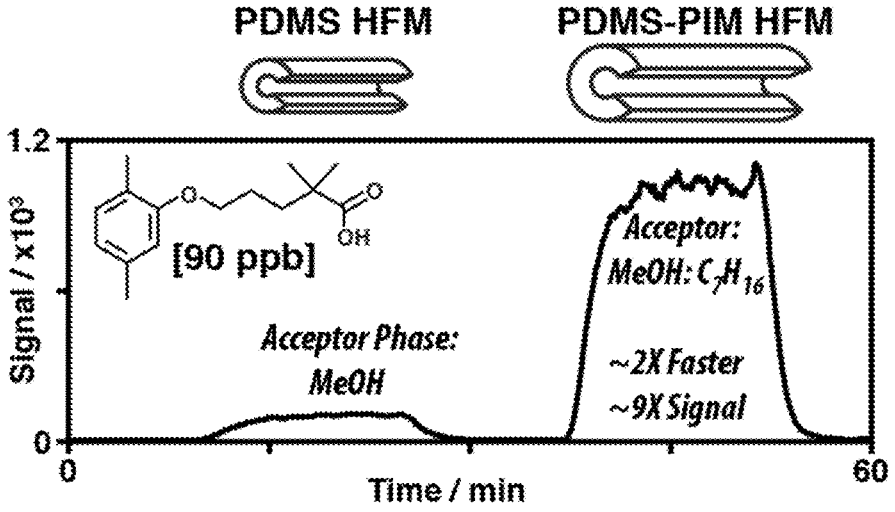
FIG. 23 shows the effect of an acceptor phase modifier on signal response time and sensitivity. The left signal trace shows the signal strength when methanol was used as the acceptor phase. The right scan shows the signal strength when ten percent heptane in methanol (v:v)was used as the acceptor phase. The exemplary analyte was gemfibrozil. The effect of the acceptor phase modifier on the membrane is shown above the graph.

As shown in FIG. 23, acceptor phase modifiers improve membrane transport and/or improve ionization efficiency. Acceptor phase modifiers include simple alkanes, simple aromatics, simple alkanes functionalized with amines or carboxylates, and simple aromatics functionalized with amines or carboxylates. In this example, 10% v/v heptane was added to the acceptor phase to produce a PDMS-PIM HFM. This resulted in increasing signal nine-fold and decreasing the signal response time two-fold.

The foregoing is an example of the present technology. As would be known to one skilled in the art, variations that do not alter the scope of the technology are contemplated.

TABLE 1

Physical data and MS scan parameters for the target analytes studied.

| Target Analyte | Chemical Abstract Service | Molar mass (g/mol) | Vapour pressure (Pa)[a] | Log $K_{ow}$[a] | Molar Volume ($cm^3$/mol)[b] | MS Entrance Cone (V) | MS Scan Parameters (m/z)[c] |
|---|---|---|---|---|---|---|---|
| Abietic Acid | 514-10-3 | 302.45 | $4.3 \times 10^{-5}$ | 6.46 | 270 | −50 | 301 |
| Estrone | 53-16-7 | 270.37 | $3 \times 10^{-8}$ | 3.25 | 230 | −50 | 269 → 145 |
| Gemfibrozil | 25812-30-0 | 250.33 | $8.1 \times 10^{-5}$ | 4.30 | 240 | −20 | 249 → 120 |
| Nonyl-phenol | 25154-52-3 | 220.35 | 1.15 | 5.76 | 236 | −40 | 219 → 133 |
| 2,4,6-Trichlorophenol | 88-06-2 | 197.45 | 2.3 | 3.67 | 124 | −40 | 197 |
| Triclosan | 3380-34-5 | 289.54 | $8.6 \times 10^{-5}$ | 4.76 | 195 | −20 | 289 |

[a]SRC Physical Properties Database

[b]Calculated using ACD software

[c]SIM or SRM (→) as indicated, negative ion mode for all

TABLE 2

Detection limits and response times determined for a variety of analytes measured by CP-MIMS employing three different PDMS HFM interfaces

| | Lowest | 215 μm thick PDMS HFM | | 35 μm thick PDMS HFM | | Composite PDMS HFM (0.5 μm thick) | |
|---|---|---|---|---|---|---|---|
| Analyte | Measured Conc./ppb | $t_{10\text{-}90\%}$/min | Detection limit/ppb[a] | $t_{10\text{-}90\%}$/min | Detection limit/ppb | $t_{10\text{-}90\%}$/min | Detection limit/ppb |
| Abietic Acid | 29 | 16.5 | 1 | 12.5 | 2 | 1.6 | 0.6 |
| Estrone | 66 | 7.5 | 4 | 1.8 | 12 | 0.6 | 3 |
| Gemfibrozil | 9 | 4.7 | 0.2 | 3.7 | 0.5 | 0.8 | 0.04 |
| Nonyl-phenol | 5 | 9.5 | 0.1 | 3.5 | 2 | 1.0 | 0.5 |
| 2,4,6-Trichlorophenol | 4 | 2.5 | 0.03 | 0.7 | 0.2 | 0.3 | 0.04 |
| Triclosan | 8 | 5.8 | 0.1 | 2.0 | 0.5 | 0.6 | 0.1 |

[a]Detection limits based on S/N = 3

TABLE 3

Analysis of signal-to-noise ratios (S/N) and average signal rise times for selected NA obtained for Merichem NA in DI and River Water spiked at 440 ppb total NA.

| Molecular Formula | m/z | S/N Ratios DI Water | S/N Ratios River Water | Average $t_{10\text{-}90\%}$/min. |
|---|---|---|---|---|
| $C_9H_{18}O_2$ | 157 | 25.5 | 22.1 | 0.7 |
| $C_{13}H_{22}O_2$ | 209 | 123 | 17.6 | 1.0 |
| $C_{13}H_{24}O_2$ | 211 | 81.1 | 12.5 | 1.0 |
| $C_{13}H_{26}O_2$ | 213 | 64.3 | 17.5 | 1.3 |
| $C_{15}H_{26}O_2$ | 237 | 180 | 22.5 | 1.2 |
| $C_{16}H_{28}O_2$ | 251 | 420 | 32.8 | 1.2 |
| $C_{17}H_{30}O_2$ | 265 | 70.4 | 44.0 | 1.5 |
| $C_{18}H_{32}O_2$ | 279 | 75.8 | 22.3 | 1.4 |

TABLE 4

Performance characteristics for selected naphthenic acid isomer families ($C_nH_{2n+z}O_2$) for Merichem mixture using 'J-probe' immersion type interface with 2 cm membrane length.

| Membrane PDMS thickness | m/z | Response Times $t_{10\text{-}90}$ (mins) 213 | 223 | 237 | 251 | 305 | Sensitivity Est. DLs (ppb) 213 | 223 | 237 | 251 | 305 |
|---|---|---|---|---|---|---|---|---|---|---|---|
| | Isomer class | 13, 0 | 14, −2 | 15, −2 | 16, −2 | 20, −3 | 13, 0 | 14, −2 | 15, −2 | 16, −2 | 20, −3 |
| | n, z | 14, −6 | 15, −8 | 16, −8 | 17, −8 | 21, −9 | 14, −6 | 15, −8 | 16, −8 | 17, −8 | 21, −9 |
| 0.5 μm composite[1] | | 0.6 | 0.6 | 0.6 | 0.7 | 3.0 | 20 | 20 | 40 | 30 | 30 |
| 35 μm[2] | | 10 | 15 | 15 | 20 | 20 | 10 | 5 | 20 | 20 | 20 |
| 170 μm[3] | | 10 | 15 | 25 | 25 | 30 | 10 | 5 | 5 | 5 | 10 |

[1]plasma deposited thin film PDMS on microporous polypropylene, neoMecs Inc. (O.D. = 0.264; I.D. = 0.263)
[2]MedArray Inc (O.D. = 0.24 mm; I.D. = 0.17 mm)
[3]Silastic Dow-Corning (O.D. = 0.64 mm; I.D. = 0.30 mm)

What is claimed is:

1. A system for analyzing a sample comprising an analyte, the system comprising:

an acceptor phase supply comprising an acceptor phase;

an ionization source;

a mass spectrometer; and a membrane interface device, the device comprising a membrane interface in fluid communication with an acceptor phase carrier, the membrane interface configured for bathing in the sample, under ambient pressure, the acceptor phase carrier in fluid communication with the acceptor phase supply, the ionization source and the mass spectrometer.

2. The system of claim 1, wherein the membrane interface is a hollow fibre membrane (HFM) comprising polydimethylsiloxane, of no more than about 225 microns in thickness.

3. The system of claim 2, wherein the membrane is a thin membrane.

4. The system of claim 2, wherein the membrane is a supported liquid membrane.

5. The system of claim 2, wherein the probe is a J probe.

6. The system of claim 2, wherein the probe is a miniature coaxial probe.

7. The system of claim 6, further comprising an autosampler.

8. The membrane interface device of claim 6, wherein the miniature coaxial probe is an immersion probe, the probe comprising a membrane interface coaxial with-an acceptor phase delivery capillary and for fluid communication with the acceptor phase, the membrane interface configured for bathing in the sample, under ambient pressure, the acceptor phase delivery capillary in fluid communication with the acceptor phase supply, the ionization source and the mass spectrometer.

9. The system of claim 1, further comprising a mixer for mixing the sample.

10. An immersion probe for use with an ionization source and a mass spectrometer, the immersion probe comprising a membrane interface coaxial with an acceptor phase delivery capillary and for fluid communication with an acceptor phase, the membrane interface configured for bathing in the sample, under ambient pressure, the acceptor phase delivery capillary for fluid communication with acceptor phase supply, the ionization source and the mass spectrometer.

11. The probe of claim 10, wherein the membrane interface is a hollow fibre membrane (HFM) comprising polydimethylsiloxane, of about 0.5 microns to about 225 microns in thickness.

12. The probe of claim 11, wherein the HFM is a composite PDMS micro-porous polypropylene HFM, a thin PDMS HFM or a supported liquid membrane HFM.

13. A method of quantifying and measuring a trace level analyte in a sample, the sample being between about 1.0 μL to about 1 mL, the method comprising:

exposing a membrane interface device to a sample, such that the membrane interface device is bathed in the sample;

moving the sample over the membrane interface device;

delivering an acceptor phase to the membrane interface device via an acceptor phase carrier;

delivering the analyte to an ionization source and to a mass spectrometer; and obtaining an output, thereby quantifying and measuring the trace level analyte.

14. The method of claim 13, wherein the measuring is direct.

15. The method of claim 14, wherein the sample is a biological sample or an environmental sample.

16. The method of claim 15, further comprising rapid prescreening the sample and providing the sample for further analyzing.

17. The method of claim 15, wherein the measuring and quantifying provides direct, in vivo or in situ monitoring of the biological or the environmental sample.

18. The method of claim 14, wherein the acceptor phase includes at least one of an internal standard, an acceptor phase ionization enhancer and an acceptor phase modifier.

19. The method of claim 18, further comprising varying the acceptor flow rate.

20. The method of claim 19, wherein the acceptor phase includes an acceptor phase modifier to provide a PDMS-PIM (Polymer Inclusion Membrane) HFM.

21. The method of claim 14, wherein the membrane interface device is an immersion probe.

* * * * *